US007798819B2

(12) United States Patent
Kudo et al.

(10) Patent No.: US 7,798,819 B2
(45) Date of Patent: Sep. 21, 2010

(54) CONNECTOR

(75) Inventors: Takaaki Kudo, Tokyo (JP); Masao Higuchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/255,068

(22) Filed: Oct. 21, 2008

(65) Prior Publication Data

US 2009/0130867 A1 May 21, 2009

(30) Foreign Application Priority Data

Nov. 16, 2007 (JP) ..... 2007-298460

(51) Int. Cl.
*H01R 12/00* (2006.01)

(52) U.S. Cl. ..... 439/74; 439/83; 439/567

(58) Field of Classification Search ..... 439/74, 439/567, 83

See application file for complete search history.

(56) References Cited

U.S. PATENT DOCUMENTS 4,588,854 A * 5/1986 Bailey et al. ..... 174/535
5,409,386 A * 4/1995 Banakis et al. ..... 439/83
6,902,411 B2 * 6/2005 Kubo ..... 439/74
7,413,444 B2 * 8/2008 Wang ..... 439/74
7,497,697 B2 * 3/2009 Hoshino et al. ..... 439/74

FOREIGN PATENT DOCUMENTS

JP 2003-100394 A 4/2003

* cited by examiner

*Primary Examiner*—Truc T Nguyen
(74) *Attorney, Agent, or Firm*—Frishauf, Holtz, Goodman & Chick, P.C.

(57) ABSTRACT

Provided is a connector capable of facilitating a work of connecting first and second connection targets. A first receiving part to be coupled to a first plug connector and a second receiving part to be coupled to a second plug connector are formed at the housing of a relay connector which electrically connects the first and second plug connectors to be mounted on a chassis. The housing is provided with a contact which establishes conduction between the first plug connector coupled to the first receiving part and the second plug connector coupled to the second receiving part. The housing comprises a housing body having the first and second receiving parts, and a hook provided at the housing body to engage with a hole provided in the chassis.

2 Claims, 23 Drawing Sheets

CONNECTOR

BACKGROUND OF THE INVENTION

1. Field of the Invention

The present invention relates to a connector.

2. Description of the Related Art

There is known a plug (connector) which connects a first receptacle (first connection target) mounted on a first flexible board to a second receptacle (second connection target) mounted on a second flexible board (see Japanese Patent Application Laid-Open No. 2003-100394).

The plug has a plug body and a jumper lead.

The plug body has a first groove area, a second groove area, and a pair of link portions. The first groove area is to be coupled to the first receptacle, and has a plurality of grooves formed therein. The second groove area is to be coupled to the second receptacle, and has a plurality of grooves formed therein. The pair of link portions, which are flexible, couple the first groove area to the second groove area.

The jumper lead is a nearly belt-like thin metal plate having leg portions formed at both end portions thereof. The leg portion at one end portion of the jumper lead is inserted into the groove of the first groove area, and the distal end portion of the leg portion protrudes from the groove. The leg portion at the other end portion of the jumper lead is inserted into the groove of the second groove area, and the distal end portion of the leg portion also protrudes from the groove.

The plug is fitted in the first and second receptacles in such a way as to cover the first and second receptacles placed at predetermined positions. When the plug is fitted in the first and second receptacles, the distal end portion of the leg portion at one end portion of the jumper lead of the plug is inserted into the groove of the first receptacle to contact the terminal of the first receptacle, and the distal end portion of the leg portion at the other end portion of the jumper lead of the plug is inserted into the groove of the second receptacle to contact the terminal of the second receptacle. As a result, the first receptacle and the second receptacle are connected together.

At the time of connecting the first receptacle to the second receptacle with the above-mentioned plug, the first and second flexible boards are placed on a mount target, such as a chassis or a casing, and the plug is fitted in the first and second receptacles mounted on the first and second flexible boards.

In contrast thereto, there is a case where a bottom area of the flexible board opposite to the area thereof where the receptacle is mounted is desired to be used as an electronic part mounting area. For example, an LED (Light Emitting Diode) is to be mounted on the entire opposite surface to the surface of the flexible board where the receptacle is mounted.

In this case, the plug is placed between the mount target and the first and second flexible boards.

Because the plug is not fixed to the mount target, however, the plug may move on the mount target when the plug is fitted in the first and second receptacles of the flexible boards, so that the connecting work cannot be carried out easily.

SUMMARY OF THE INVENTION

Accordingly, it is an object of the present invention to provide a connector capable of facilitating a work of connecting first and second connection targets.

To achieve the object, the present invention provides a connector comprising a housing having a first link portion to which a first connection target to be mounted at a mount target is coupled and a second link portion to which a second connection target to be mounted at the mount target is coupled, and a contact held at the housing to establish conduction between the first connection target coupled to the first link portion and the second connection target coupled to the second link portion, the housing having a housing body having the first and second link portions, and an engagement portion which is provided at the housing body to engage with a to-be-engaged portion provided at the mount target.

According to this connector, since the housing has the housing body having the first and second link portions, and the engagement portion which is provided at the housing body to engage with the to-be-engaged portion provided at the mount target, the housing can be fixed to the mount target, so that the connector does not move at the time of connecting the first and second connection targets to the first and second link portions.

It is preferable that the to-be-engaged portion should be a hole and the engagement portion should be an elastic hook to be engaged with the hole.

The housing preferably has a projection to be inserted, together with the hook, into the hole, to restrict elastic deformation of the hook.

It is preferable that the housing body should consist of a first housing body constituting member and a second housing body constituting member which is separate therefrom and independent thereof, each of the first and second housing body constituting members should have the engagement portion, and the contact should connect the first and second housing body constituting members and should have an expanding portion which absorbs relative deviation between the first and second connection targets.

DETAILED DESCRIPTION OF THE PREFERRED EMBODIMENTS

Preferred embodiments of the present invention will now be described referring to the accompanying drawings.

Figure 1:
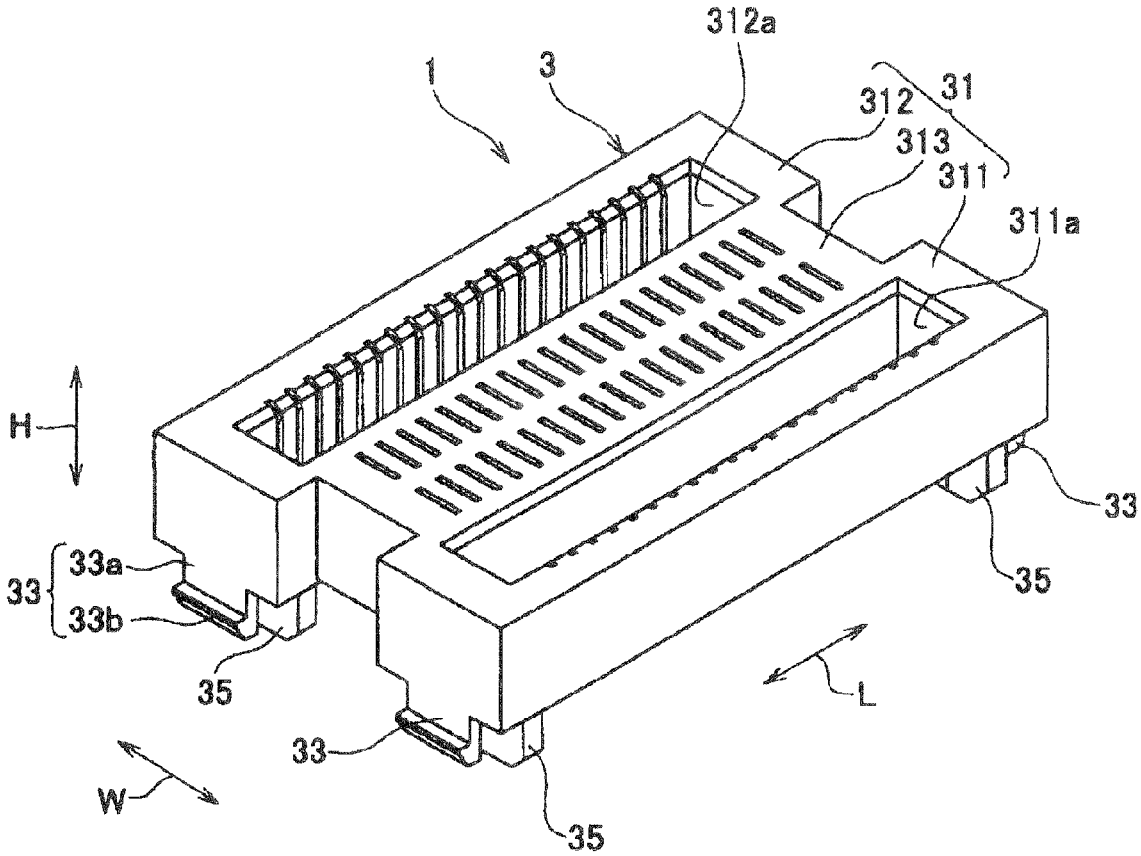
FIG. 1 is a perspective view of a relay connector according to a first embodiment of the present invention.
Figure 2:
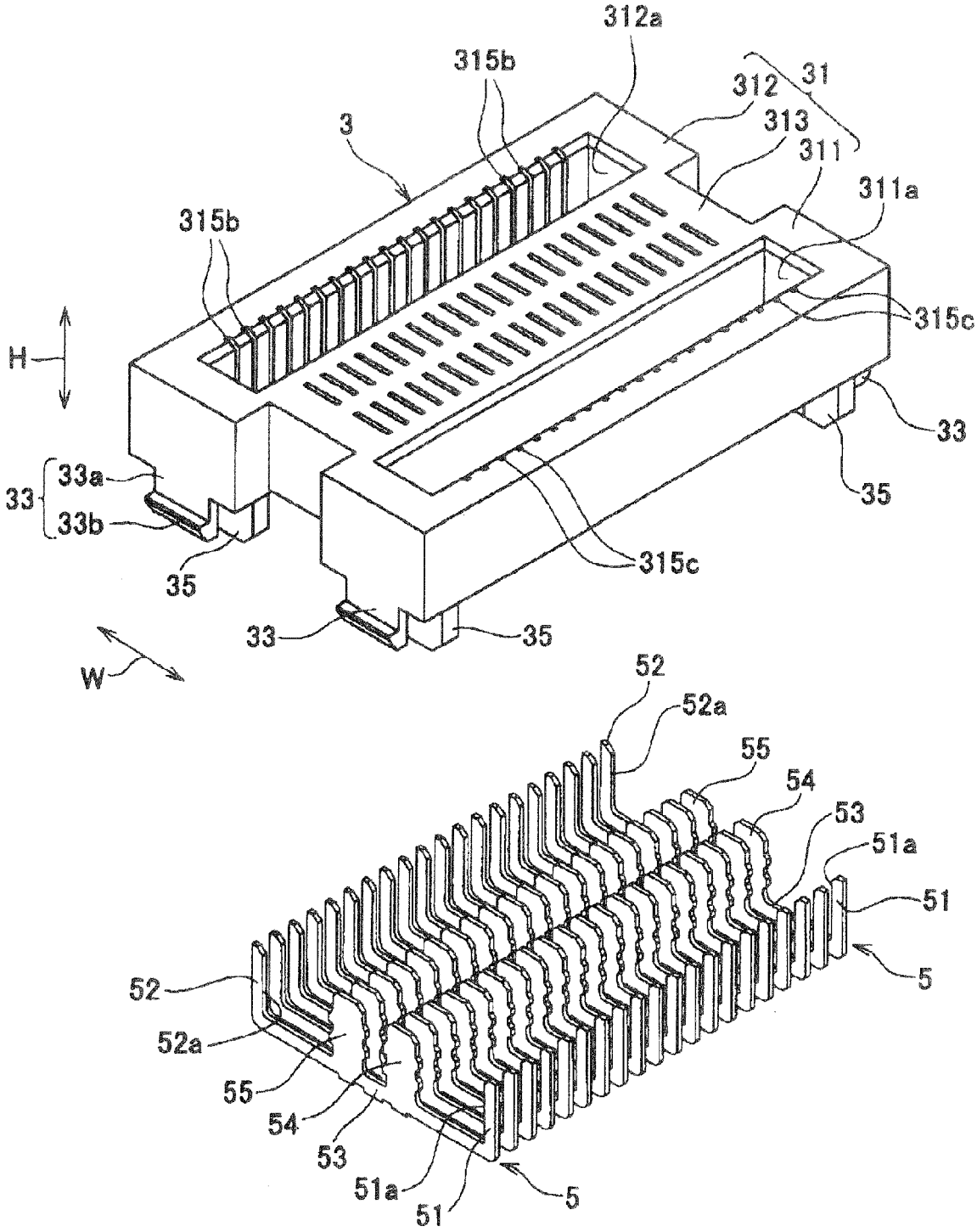
FIG. 2 is an exploded perspective view of the relay connector shown in FIG. 1.
Figure 3:
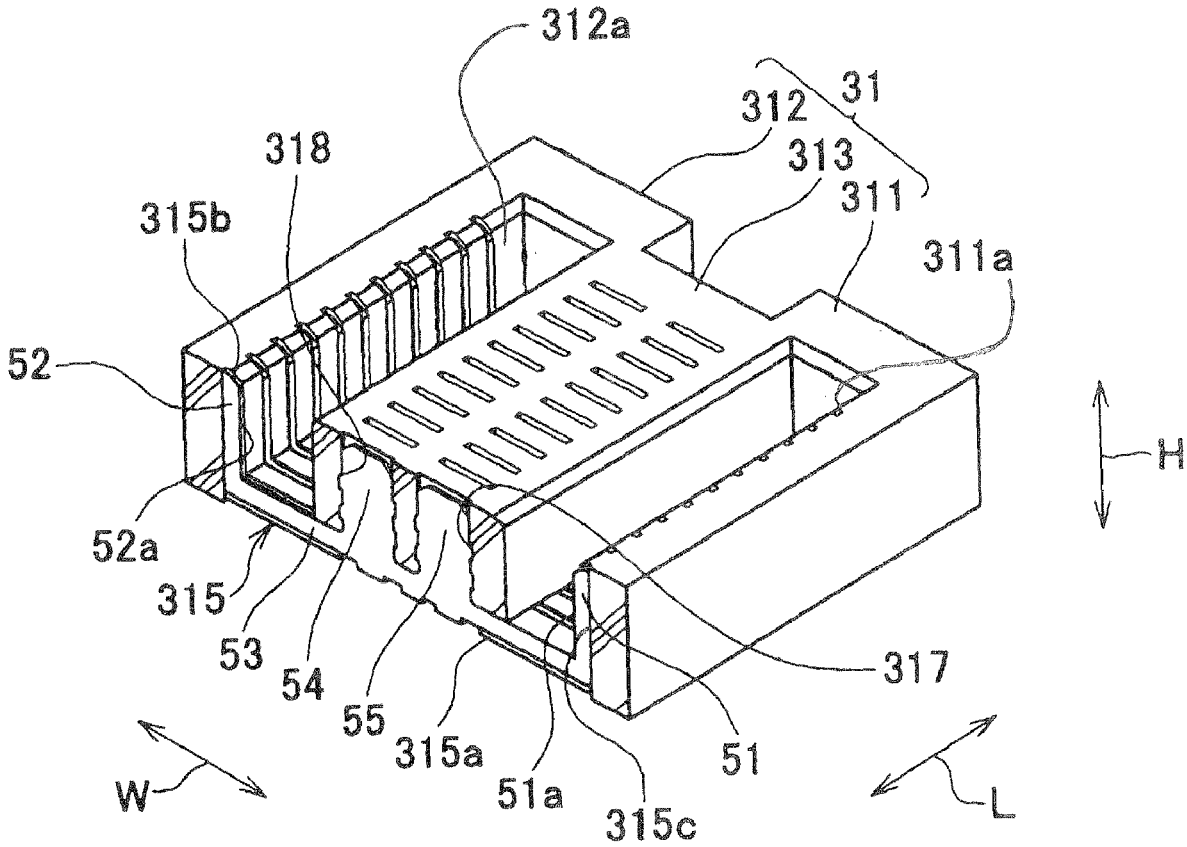
FIG. 3 is a cross-sectional view of the relay connector shown in FIG. 1.

As shown in FIGS. 1 to 3, a relay connector (connector) 1 has a housing 3 and contacts 5.

The housing 3 includes a housing body 31, hooks (engagement portions) 33, and projections 35.

The housing body 31 has a first receiving part (first link portion) 311, a second receiving part (second link portion) 312, and a fixing part 313.

The first receiving part 311 has nearly the shape of a casing. The first receiving part 311 receives a first plug connector 80, so that the first plug connector 80 is coupled to the first receiving part 311.

The second receiving part 312 has nearly the shape of a casing. The second receiving part 312 receives a second plug connector 80', so that the second plug connector 80' is coupled to the second receiving part 312.

The fixing part 313, which has a nearly rectangular parallelepiped shape, couples the first receiving part 311 and the second receiving part 312 together.

A plurality of contact retaining grooves 315 are formed in the housing body 31 in a lengthwise direction L of the housing 3 at equal intervals. As shown in FIG. 3, the contact retaining groove 315 has a lateral groove portion 315*a*, a longitudinal groove portion 315*b* and a longitudinal groove portion 315*c*. The lateral groove portions 315*a* are provided at the bottom surfaces of the first and second receiving parts 311, 312 and the fixing part 313, and extend in a widthwise direction W of the housing 3. The longitudinal groove portions 315*c* are provided at an inner peripheral surface 311*a* of the first receiving part 311, and extend in a heightwise direction H of the housing 3. The longitudinal groove portions 315*b* are provided at an inner peripheral surface 312*a* of the second receiving part 312, and extend in the heightwise direction H of the housing 3.

A plurality of press-in holes 317, 318 are formed in the fixing part 313 in the lengthwise direction L thereof at equal intervals. The press-in holes 317, 318 extend in the heightwise direction H of the housing 3. The press-in holes 317, 318 communicate with the lateral groove portions 315*a* of the contact retaining grooves 315.

The hooks 33 are provided at the bottom surfaces of both end portions of the first receiving part 311 and at the bottom surfaces of both end portions of the second receiving part 312. The hook 33 has an arm part 33*a* and a claw 33*b*. The arm part 33*a* has a thin plate-like shape and elasticity. The claw 33*b* is coupled to the lower end of the arm part 33*a*. The claw 33*b* has a nearly triangular cross-sectional shape.

The projections 35 are provided at the bottom surfaces of both end portions of the first receiving part 311 and at the bottom surfaces of both end portions of the second receiving part 312 in such a way as to be adjacent to the respective hooks 33. There is a clearance between the projection 35 and the hook 33. The projection 35, which has a plate-like shape, restricts the elastic deformation of the hook 33 so that the hook 33 does not have excessive elastic deformation.

As shown in FIG. 2, the contact 5 has a first contact portion 51, a second contact portion 52, a link portion 53, a first press-in portion 54, and a second press-in portion 55.

The first contact portion 51, which has a plate-like shape, is placed in the longitudinal groove portion 315*c* of the contact retaining groove 315. The first contact portion 51 has a contact surface 51*a* protruding from the longitudinal groove portion 315*c* to contact the first plug connector 80 to be described later.

The second contact portion 52, which has a plate-like shape, is placed in the longitudinal groove portion 315*b* of the contact retaining groove 315. The second contact portion 52 has a contact surface 52*a* protruding from the longitudinal groove portion 315*b* to contact the second plug connector 80' to be described later.

The link portion 53, which has a plate-like shape, couples the first contact portion 51 to the second contact portion 52, and is placed in the lateral groove portion 315*a* of the contact retaining groove 315.

The first and second press-in portions 54, 55, each of which has a plate-like shape, are coupled to the link portion 53, and are respectively pressed into the press-in holes 317, 318. The first and second press-in portions 54, 55 are respectively pressed into the press-in holes 317, 318, so that the contacts 5 are held in the housing 3.

Figure 4:
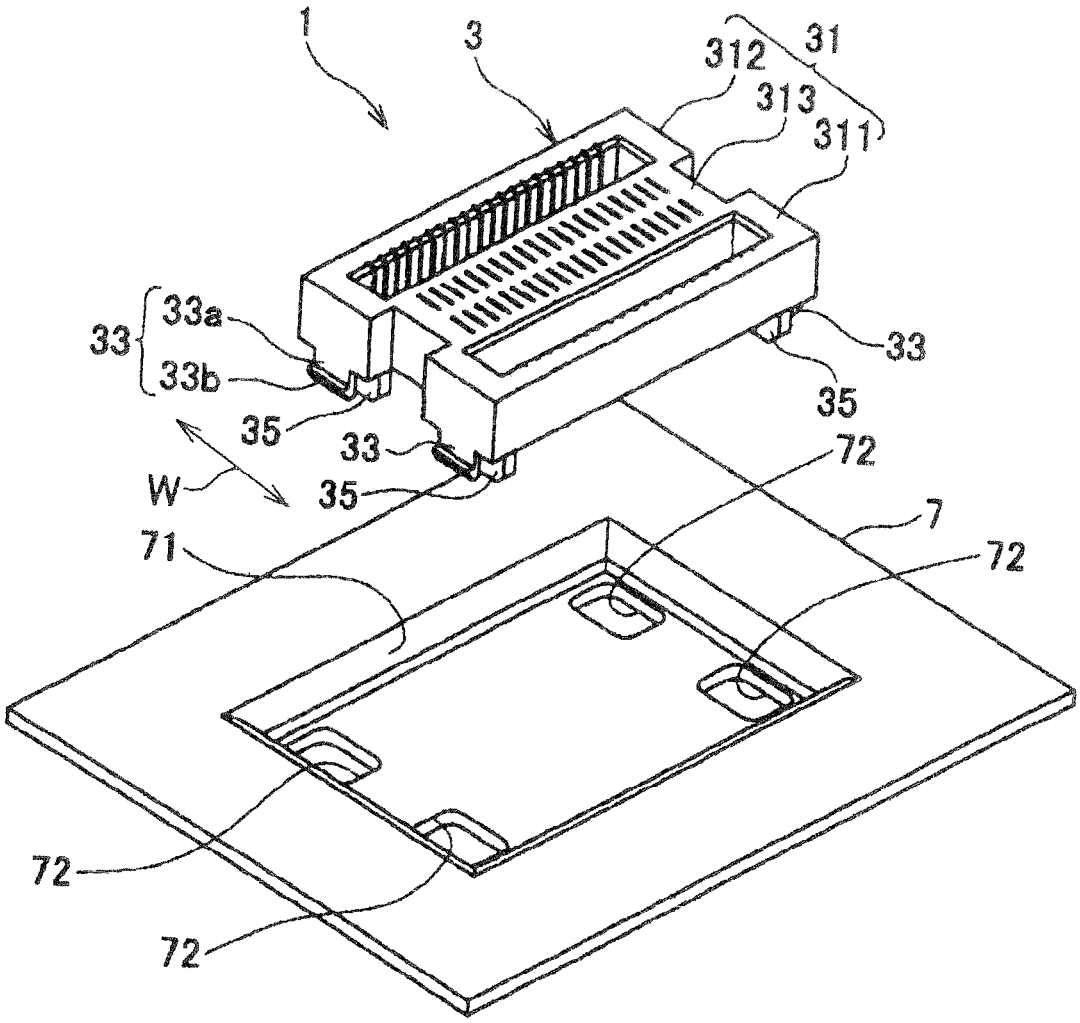
FIG. 4 is a perspective view showing a state before the relay connector shown in FIG. 1 is fixed to a chassis.
Figure 5:
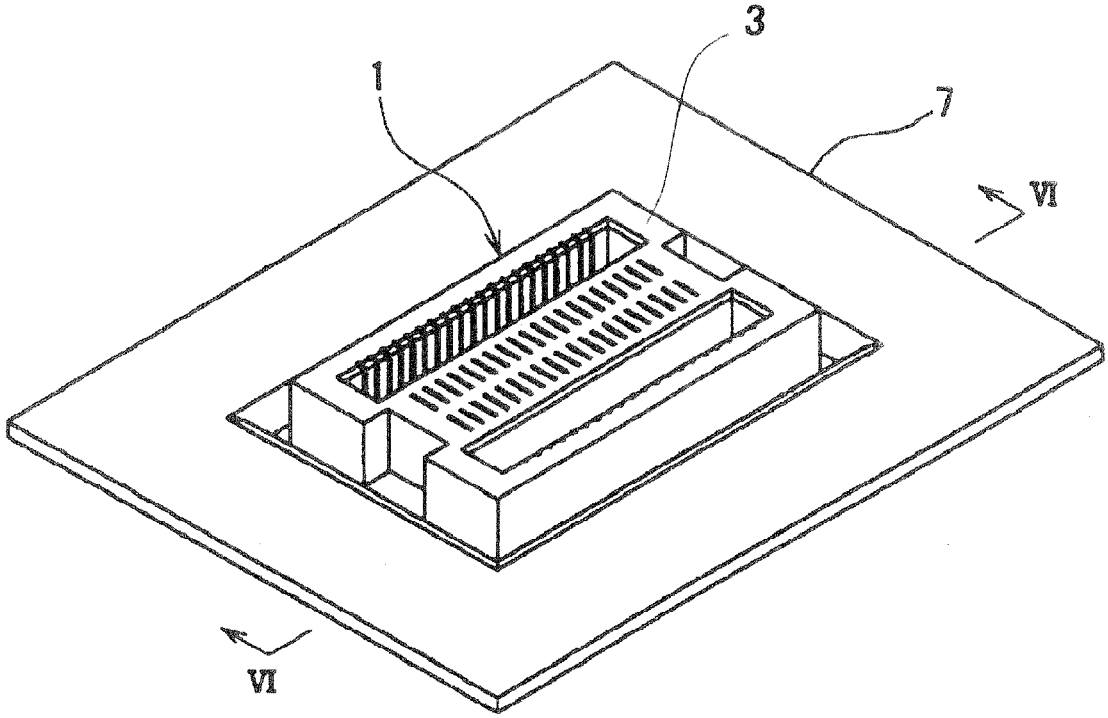
FIG. 5 is a perspective view showing a state after the relay connector shown in FIG. 1 is fixed to the chassis.

FIG. 4 is a perspective view showing a state before the relay connector 1 shown in FIG. 1 is fixed to a chassis 7; FIG. 5 is a perspective view showing a state after the relay connector 1 shown in FIG. 1 is fixed to the chassis 7; and FIG. 6 is a cross-sectional view along line VI-VI in FIG. 5.

As shown in FIG. 4, a recess 71 which retains the lower portion of the relay connector 1 is formed in the chassis 7 being a mount target on which printed board 9, 9' to be described later is to be mounted. Four holes (to-be-engaged portions) 72 are formed at four corners of the bottom surface of the recess 71. The hook 33 and projection 35 are inserted into the hole 72. The hole 72 is rectangular, and has a width (long diameter) wider than the widths of the hook 33 and projection 35, so that clearances are respectively formed between the inner peripheral surface of the hole 72 and the hook 33, and between the inner peripheral surface of the hole 72 and the projection 35 in the widthwise direction W of the housing 3. Therefore, the relay connector 1 can move in the widthwise direction W by the clearances over the chassis 7.

To fix the relay connector 1 to the chassis 7, as shown in FIG. 4, the relay connector 1 is positioned so that the hook 33 and projection 35 are positioned above the hole 72, after which the relay connector 1 is lowered to permit the hook 33 and projection 35 to be inserted into the hole 72.

Figure 6:
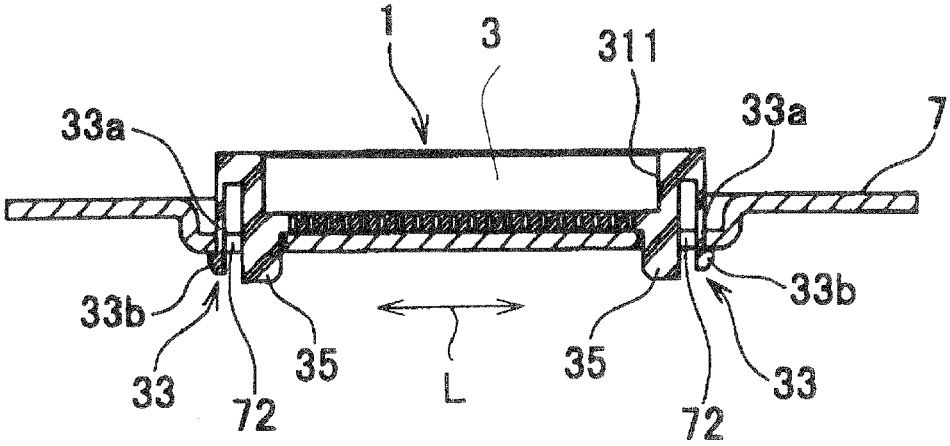
FIG. 6 is a cross-sectional view along line VI-VI in FIG. 5.

As a result, the claw 33*b* of the hook 33 is hooked at the peripheral portion of the hole 72 as shown in FIGS. 5 and 6, so that the relay connector 1 is fixed to the chassis 7.

When the relay connector 1 is fixed to the chassis 7, the arm part 33*a* of the hook 33 contacts the inner peripheral surface of the hole 72 in the lengthwise direction L of the housing 3, but a clearance is formed between the projection 35 and the inner peripheral surface of the hole 72. Therefore, the relay connector 1 can also move in the lengthwise direction L by the clearance over the chassis 7.

Figure 7:
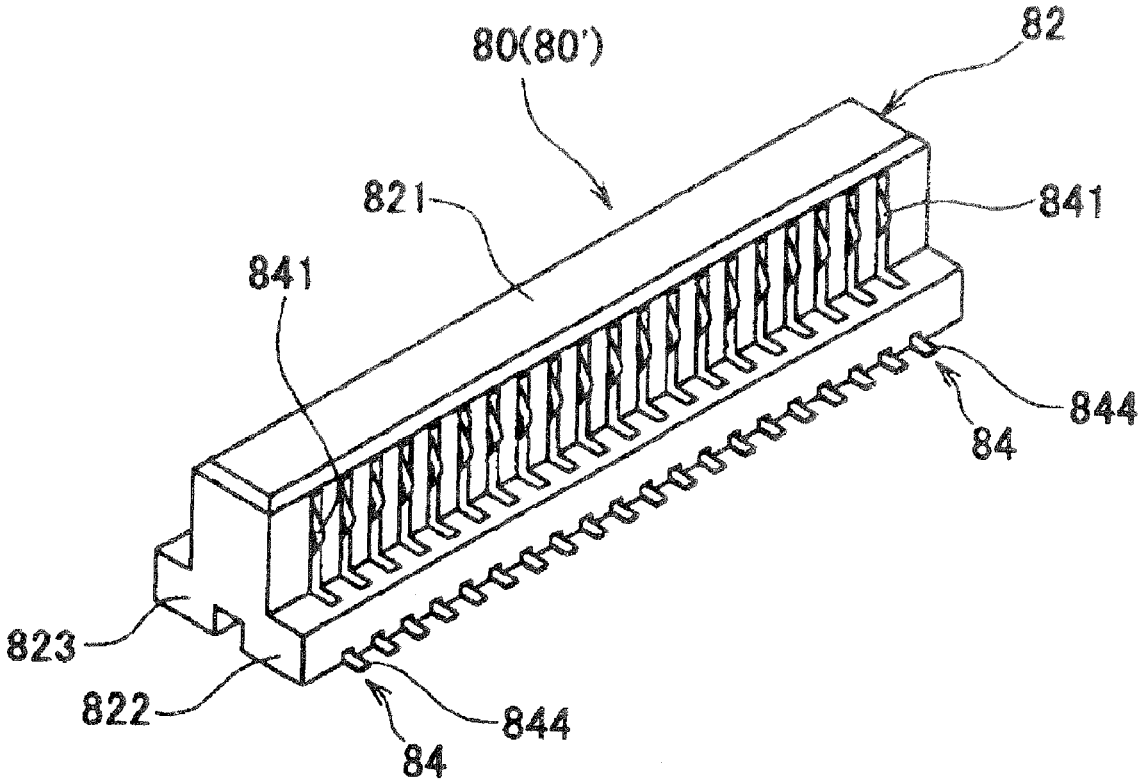
FIG. 7 is a perspective view showing of a plug connector to be connected to the relay connector shown in FIG. 1.
Figure 8:
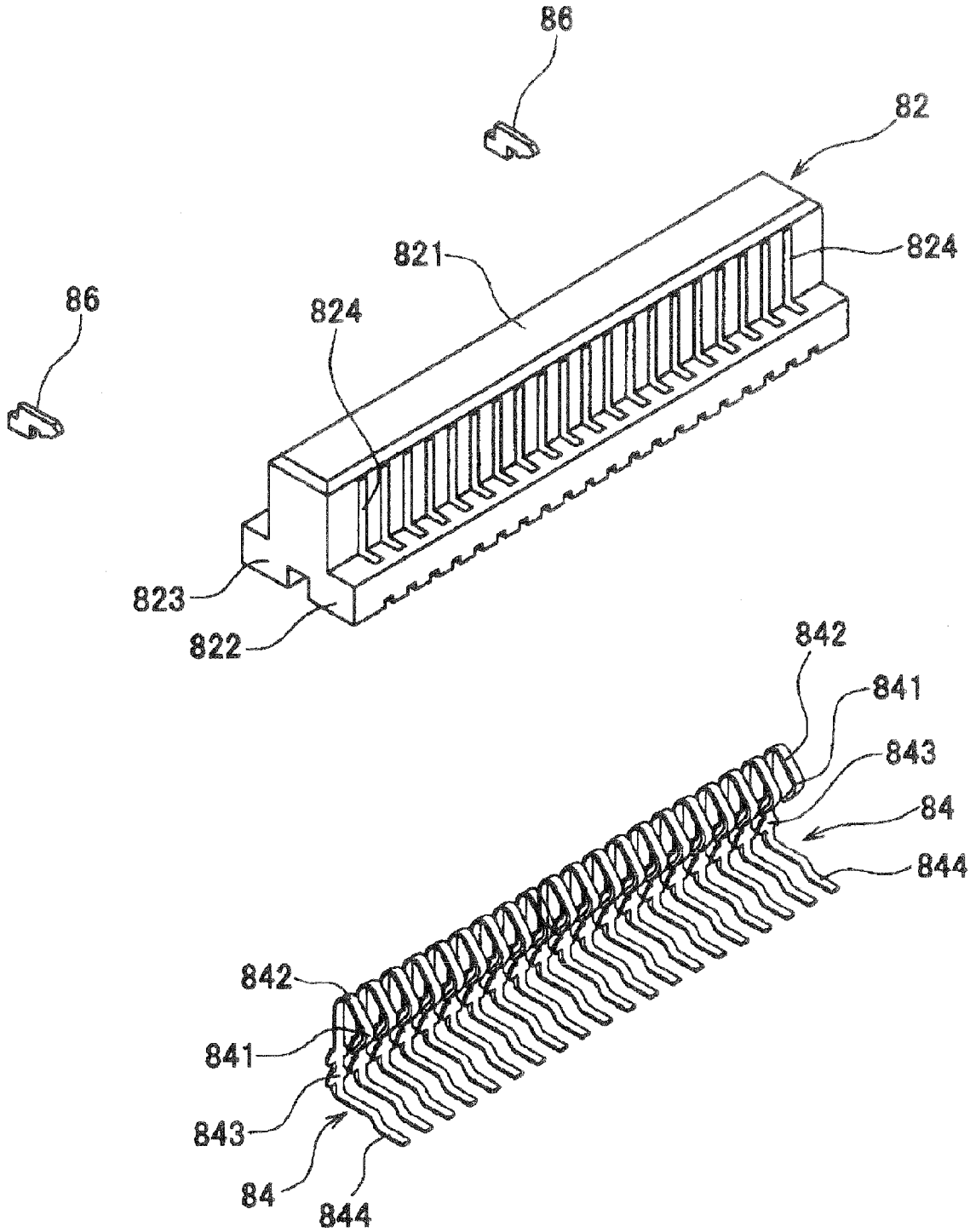
FIG. 8 is an exploded perspective view of the plug connector shown in FIG. 7.

FIG. 7 is a perspective view of the plug connector 80, 80' to be connected to the relay connector 1 shown in FIG. 1; FIG. 8 is an exploded perspective view of the plug connector 80, 80' shown in FIG. 7; and FIG. 9 is a perspective view showing a state where the plug connector 80, 80' shown in FIG. 7 is mounted on the printed board 9, 9'.

Figure 9:
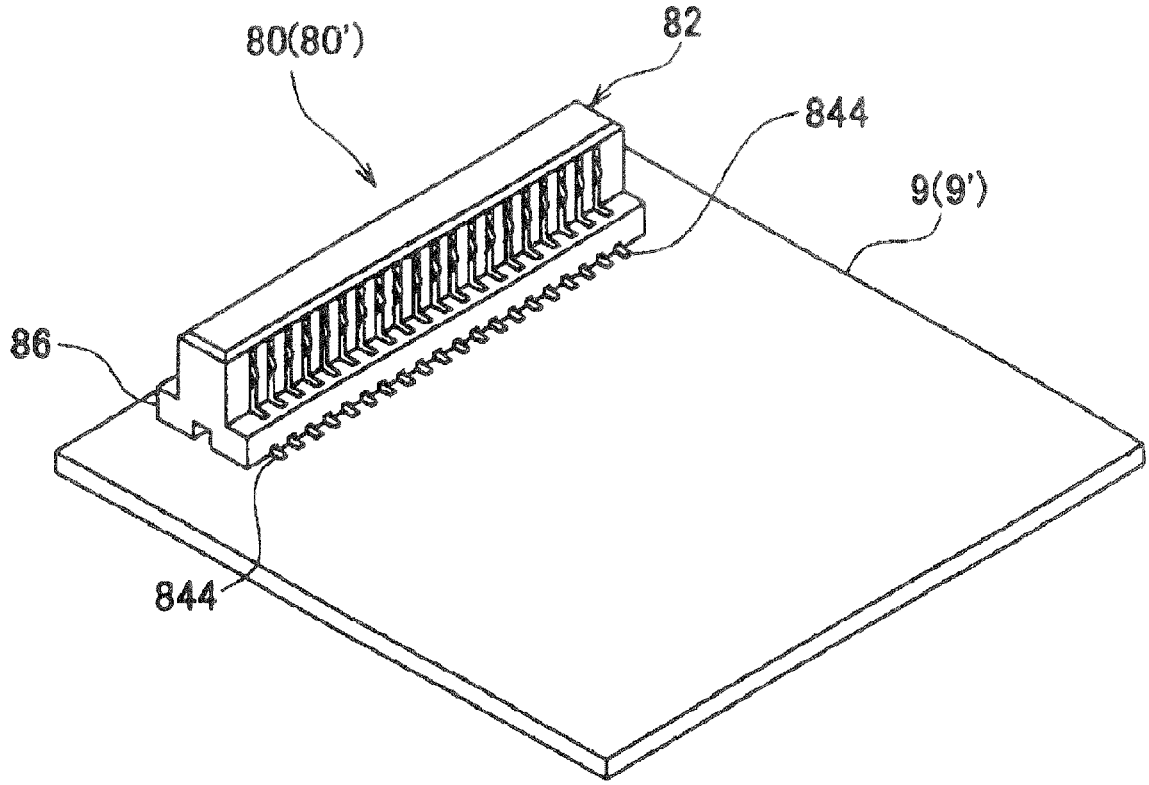
FIG. 9 is a perspective view showing a state where the plug connector shown in FIG. 7 is mounted on a printed board.

As shown in FIGS. 7 to 9, the first plug connector (first connection target) 80 has a housing 82, and contacts 84.

The housing 82 has a housing body 821 and a pair of leg portions 822, 823. The housing body 821 has a rectangular parallelepiped shape. The leg portions 822, 823 are coupled to the bottom portion of the housing body 821. The housing 82 has a plurality of contact retaining spaces 824 formed therein in the lengthwise direction thereof at equal intervals.

The contact 84 has a contact portion 841, a spring portion 842, a press-in portion 843 and a terminal portion 844. The contact portion 841 contacts the first contact portion 51 of the contact 5. The spring portion 842 is coupled to the contact portion 841. The spring portion 842 presses the contact portion 841 against the first contact portion 51. The press-in portion 843 is coupled to the spring portion 842, and is pressed into the housing 82. The pressing of the press-in portion 843 into the housing 82 causes the contact 84 to be fixed to the housing 82. The terminal portion 844 is coupled to the press-in portion 843.

The contact 84 is retained in the respective contact retaining space 824 of the housing 82. The contact portion 841 and terminal portion 844 protrude from the contact retaining space 824.

Fixing pieces 86 are pressed into both end portions of the leg portion 823 of the housing 82.

The terminal portion 844 of the first plug connector 80 and the fixing pieces 86 are soldered to a pad (not shown) of the printed board 9, so that the first plug connector 80 is mounted on the printed board 9 as shown in FIG. 9.

Since the second plug connector 80' has a similar structure to that of the first plug connector 80, the same reference numerals are allotted to omit the description therefor.

Figure 10:
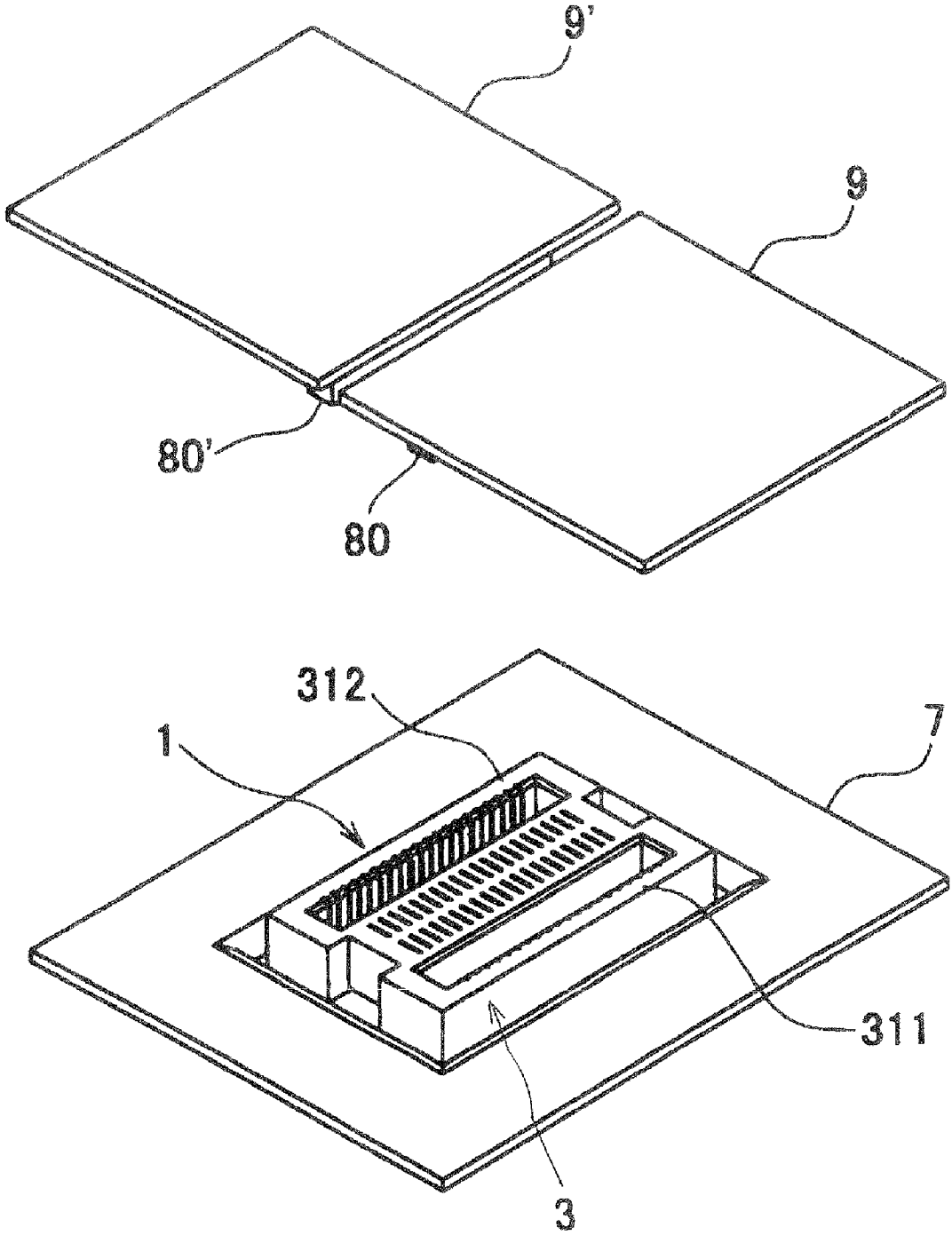
FIG. 10 is a perspective view showing a state before the plug connector is connected to the relay connector shown in FIG. 1.
Figure 11:
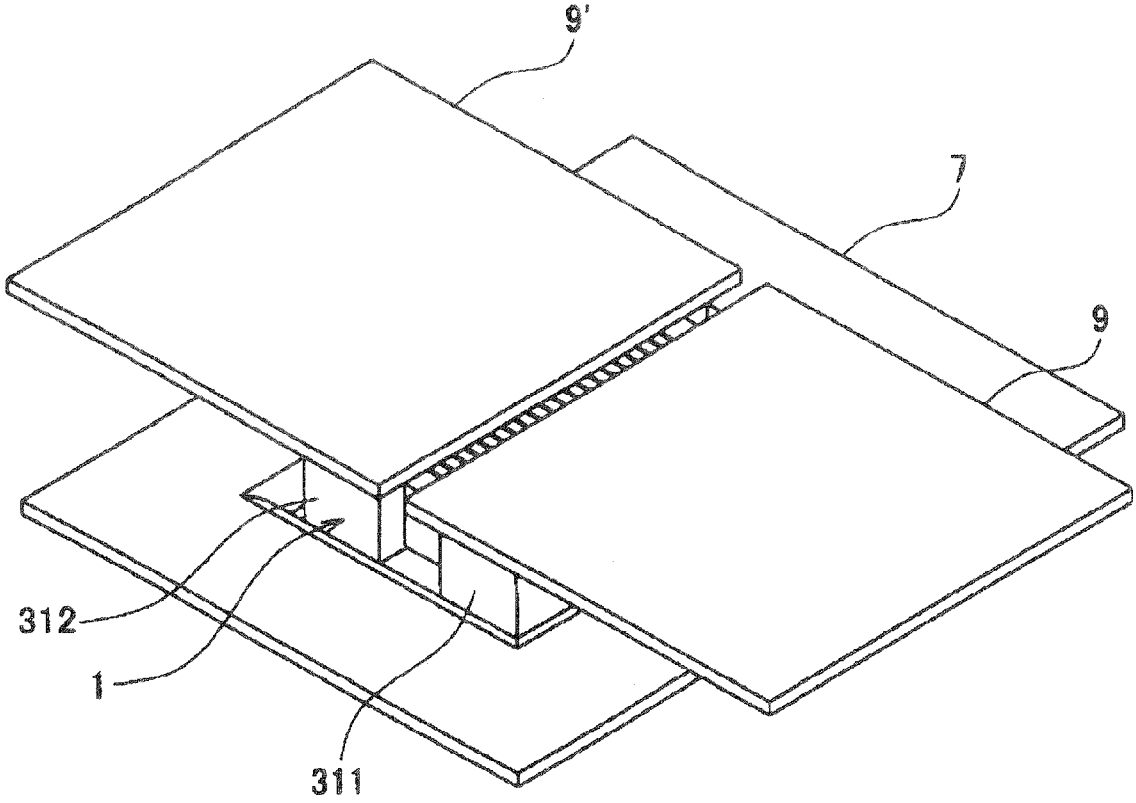
FIG. 11 is a perspective view showing a state after the plug connector is connected to the relay connector shown in FIG. 1.
Figure 12:
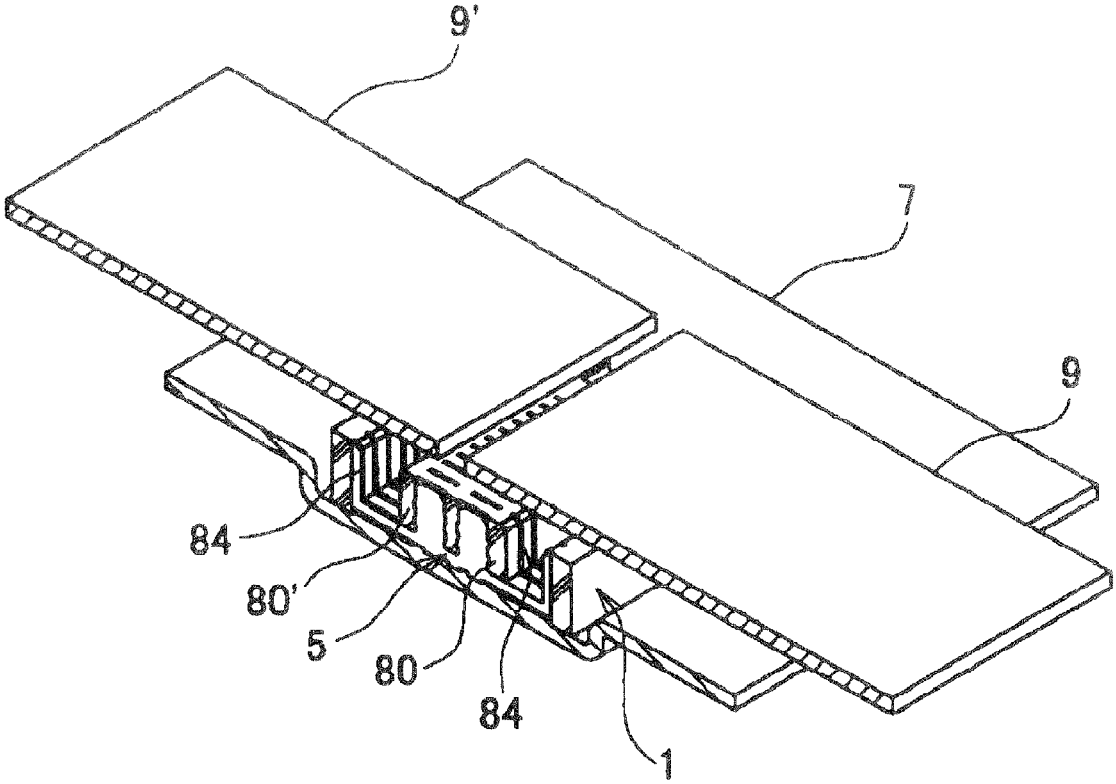
FIG. 12 is a cross-sectional view showing the state after the plug connector is connected to the relay connector shown in FIG. 1.

FIG. 10 is a perspective view showing a state before the plug connector is connected to the relay connector shown in FIG. 1; FIG. 11 is a perspective view showing a state after the plug connector is connected to the relay connector shown in FIG. 1; and FIG. 12 is a cross-sectional view showing the state after the plug connector is connected to the relay connector shown in FIG. 1.

To connect the first plug connector 80 mounted on the first printed board 9 and the second plug connector 80' mounted on the second printed board 9' to the relay connector 1, the relay connector 1 should be fixed to the chassis 7 beforehand as shown in FIG. 10.

Next, the first and second plug connectors 80, 80' are placed over the first and second receiving parts 311, 312 of the relay connector 1 respectively (see FIG. 10).

Then, as shown in FIG. 11, the first and second plug connectors 80, 80' are respectively inserted into the first and second receiving parts 311, 312 of the relay connector 1 (see FIG. 11).

Since the relay connector 1 is fixed to the chassis 7 at this time, connection of the first and second plug connectors 80, 80' to the relay connector l can be carried out easily.

Because the relay connector 1 can move on the chassis 7 a little, the positional deviation of the first and second plug connectors 80, 80' to the relay connector 1 is absorbed.

When the first and second plug connectors 80, 80' are inserted into the first and second receiving parts 311, 312 of the relay connector 1, as shown in FIG. 12, the contacts 5 contact the contacts 84, 84 of the first and second plug connectors 80, 80', allowing the first printed board 9 and the second printed board 9' to be electrically connected together via the relay connector 1 and the first and second plug connectors 80, 80'.

According to this embodiment, the relay connector 1 is fixed to the chassis 7, so that the first and second plug connectors 80, 80' can be connected to the relay connector 1 easily.

It is also possible to absorb the positional deviation of the first and second plug connectors 80, 80' with respect to the relay connector 1.

Further, when the relay connector 1 is fixed to the chassis 7, the chassis 7 serves as a reinforced plate for the relay connector 1, thus enhancing the strength of the relay connector 1.

Next, a relay connector (connector) 201 according to a second embodiment of the present invention will be described referring to FIGS. 13 to 15.

Figure 13:
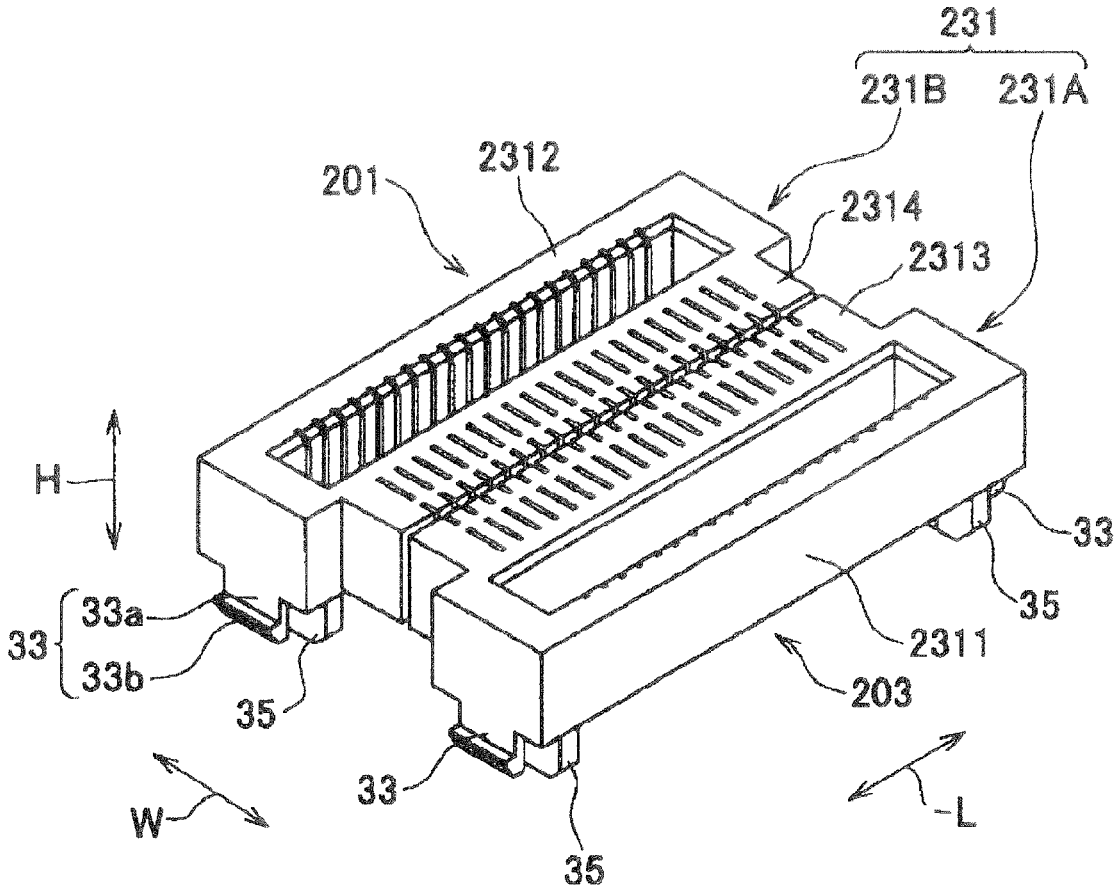
FIG. 13 is a perspective view of a relay connector according to a second embodiment of the present invention.

FIG. 13 is a perspective view of a relay connector according to the second embodiment of the present invention; FIG. 14 is a cross-sectional view of the relay connector shown in FIG. 13; and FIG. 15 is a cross-sectional view of the relay connector shown in FIG. 13.

The same reference numerals are allotted to the components in common with those of the first embodiment to omit the description therefor. The following will describe only main differences from the first embodiment.

Figure 14:
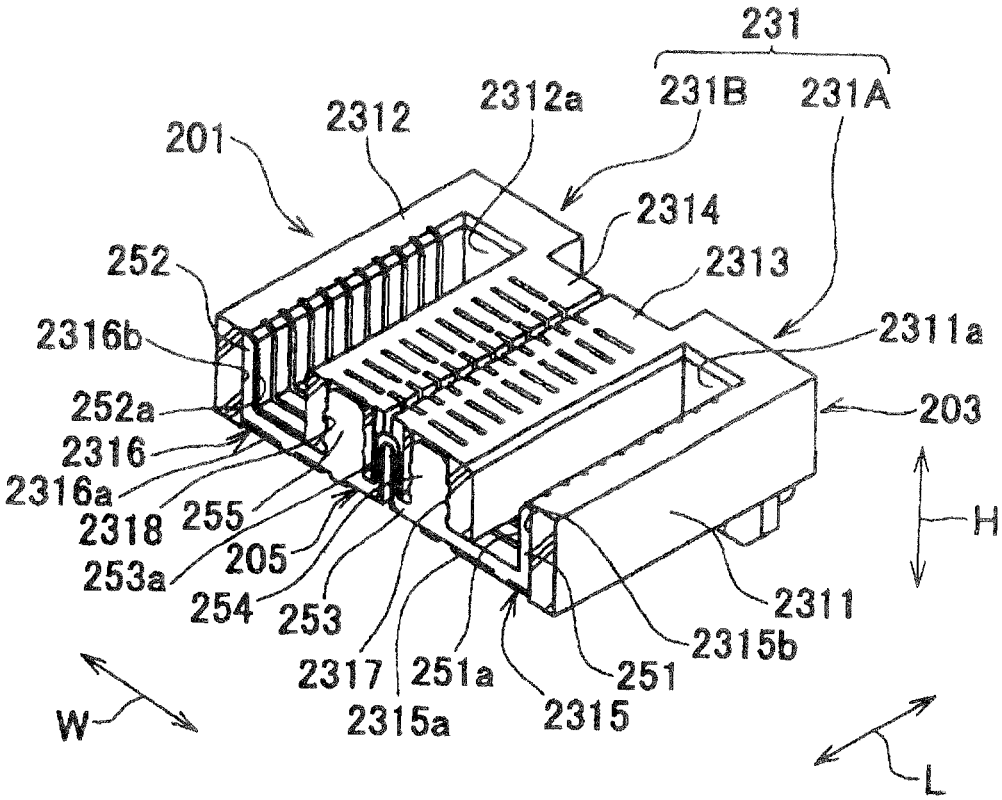
FIG. 14 is a cross-sectional view of the relay connector shown in FIG. 13.
Figure 15:
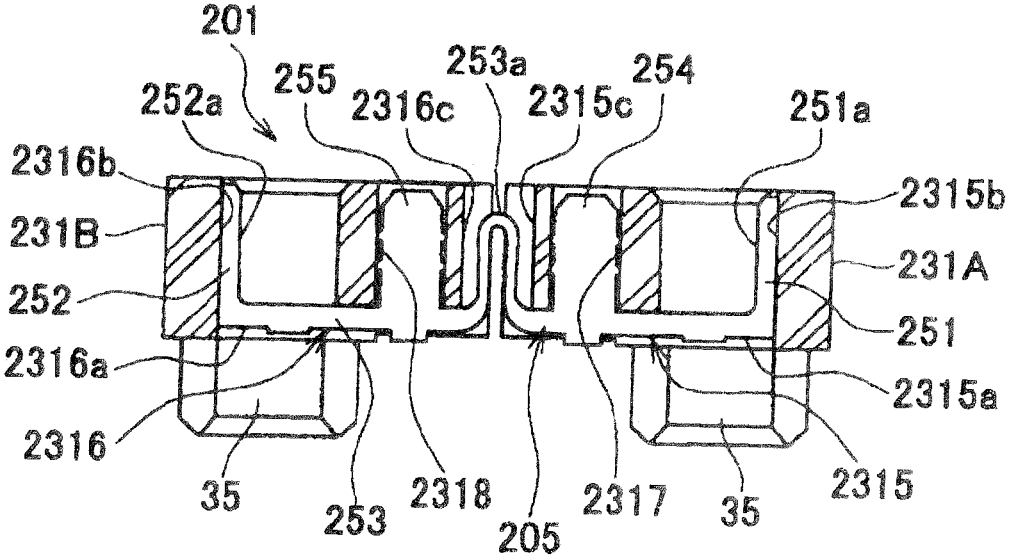
FIG. 15 is a cross-sectional view of the relay connector shown in FIG. 13.

As shown in FIGS. 13 to 15, the relay connector 201 is provided with a housing 203 and contacts 205.

The housing 203 consists of a housing body 231, hooks (engagement portions) 33 and projections 35.

The housing body 231 consists of a first housing body constituting member 231A and a second housing body constituting member 231B. The first housing body constituting member 231A and the second housing body constituting member 231B are separate from and independent of each other.

The first housing body constituting member 231A has a first receiving part (first link portion) 2311 and a first fixing part 2313.

The first receiving part 2311 has nearly the shape of a casing. The first receiving part 2311 receives a first plug connector 80, so that the first plug connector 80 is coupled to the first receiving part 2311.

The first fixing part 2313, which has a nearly rectangular parallelepiped shape, is formed at a side portion of the first receiving part 2311.

A plurality of contact retaining grooves 2315 are formed in the first housing body constituting member 231A in the lengthwise direction L of the housing 203 at equal intervals. The contact retaining groove 2315 has a lateral groove portion 2315*a*, a longitudinal groove portion 2315*b* and a longitudinal groove portion 2315*c* (see FIG. 15). The lateral groove portions 2315*a* are provided at the bottom surface of the first housing body constituting member 231A, and extend in the widthwise direction W of the housing 203. The longitudinal groove portions 2315*b* are provided at an inner peripheral surface 2311*a* of the first receiving part 2311, and extend in the heightwise direction H of the housing 203. The longitudinal groove portions 2315*c* are provided at the surface of the first fixing part 2313 which faces a second fixing part 2314 to be described later, and extend in the heightwise direction H of the housing 203.

A plurality of press-in holes 2317 are formed in the first fixing part 2313 in the lengthwise direction L of the housing 203 at equal intervals. The press-in holes 2317 extend in the heightwise direction H of the housing 203. The press-in holes 2317 communicate with the lateral groove portions 2315*a* of the contact retaining grooves 2315.

The second housing body constituting member 231B has a second receiving part (second link portion) 2312 and a second fixing part 2314.

The second receiving part 2312 has nearly the shape of a casing. The second receiving part 2312 receives the second plug connector 80', so that the second plug connector 80' is coupled to the second receiving part 2312.

The second fixing part 2314, which has a nearly rectangular parallelepiped shape, is formed at a side portion of the second receiving part 2312.

A plurality of contact retaining grooves 2316 are formed in the second housing body constituting member 231B in the lengthwise direction L of the housing 203 at equal intervals. The contact retaining groove 2316 has a lateral groove portion 2316*a*, a longitudinal groove portion 2316*b* and a longitudinal groove portion 2316*c* (see FIG. 15). The lateral groove portions 2316*a* are provided at the bottom surface of the second housing body constituting member 231B, and extend in the widthwise direction W of the housing 203. The longitudinal groove portions 2316*b* are provided at an inner peripheral surface 2312*a* of the second receiving part 2312, and extend in the heightwise direction H of the housing 203. The longitudinal groove portions 2316*c* are provided at the surface of the second fixing part 2314 which faces the first fixing part 2313, and extend in the heightwise direction H of the housing 203.

A plurality of press-in holes 2318 are formed in the second fixing part 2314 in the lengthwise direction L of the housing 203 at equal intervals. The press-in holes 2318 extend in the heightwise direction H of the housing 203. The press-in holes 2318 communicate with the lateral groove portions 2316*a* of the contact retaining grooves 2316.

The contact 205 has a first contact portion 251, a second contact portion 252, a link portion 253, a first press-in portion 254, and a second press-in portion 255.

The first contact portion 251, which has a plate-like shape, is placed in the longitudinal groove portion 2315*b* of the contact retaining groove 2315. The first contact portion 251 has a contact surface 251*a* protruding from the longitudinal groove portion 2315*b* to contact the first plug connector 80.

The second contact portion 252, which has a plate-like shape, is placed in the longitudinal groove portion 2316*b* of the contact retaining groove 2316. The second contact portion 252 has a contact surface 252*a* protruding from the longitudinal groove portion 2316*b* to contact the second plug connector 80'.

The link portion 253, which has a plate-like shape, couples the first contact portion 251 to the second contact portion 252. The link portion 253 has an expanding portion 253*a* curved in a nearly U shape. The expanding portion 253*a* couples the first and second housing body constituting members 231A, 231B, and absorbs a relative deviation between the first and second plug connectors 80, 80'. The link portion 253 is placed in the lateral groove portions 2315*a*, 2316*a* of the contact retaining grooves 2315, 2316, excluding the expanding portion 253*a*. The expanding portion 253*a* is placed in the longitudinal groove portions 2315*c*, 2316*c* of the contact retaining grooves 2315, 2316 in an elastically deformable manner.

The first and second press-in portions 254, 255 are each coupled to the link portion 253, and are respectively pressed into the press-in holes 2317, 2318. The first and second press-in portions 254, 255 are respectively pressed into the press-in holes 2317, 2318, so that the contacts 205 are held in the first and second housing body constituting members 231A, 231B.

Figure 16:
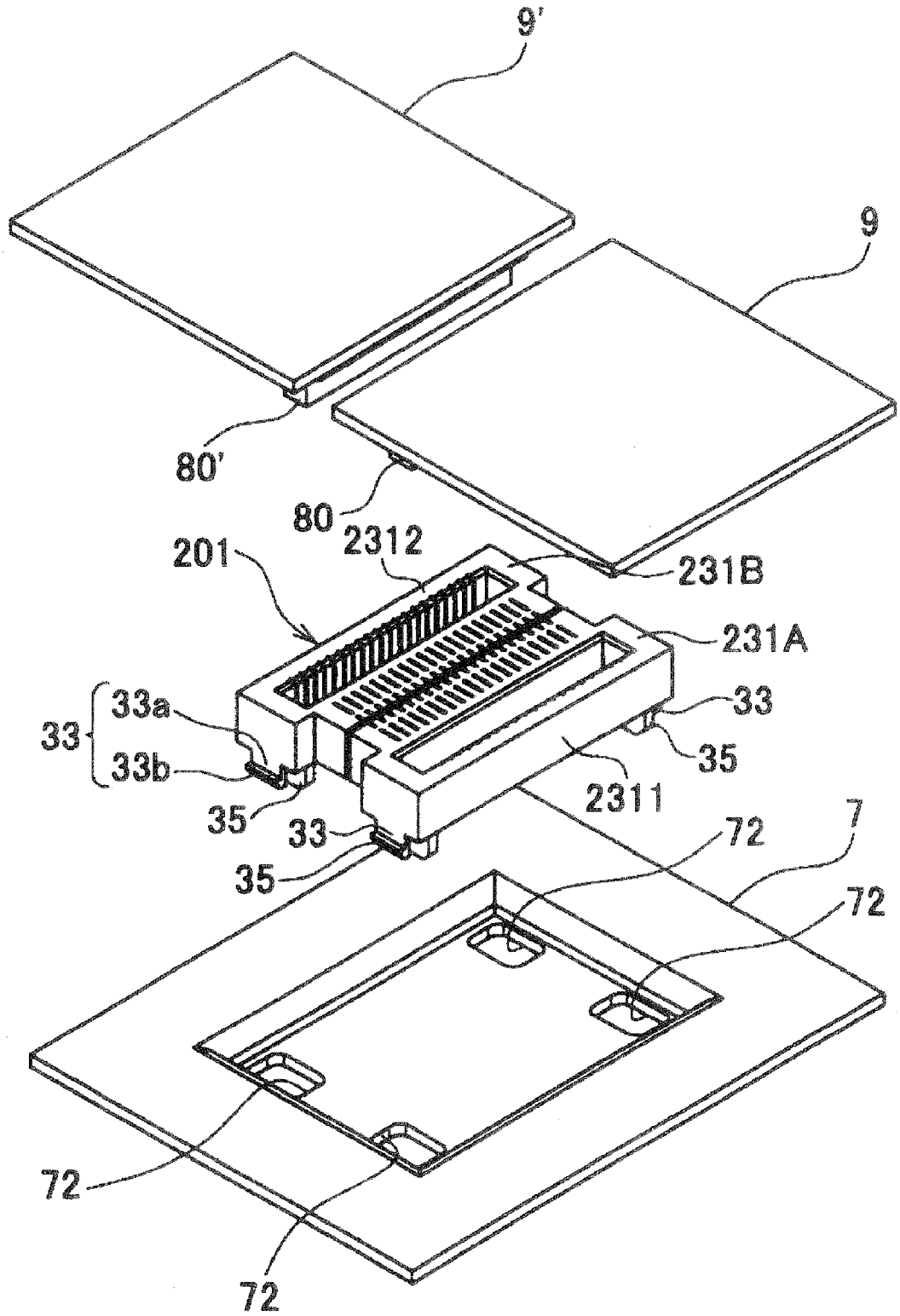
FIG. 16 is a perspective view showing a state before the relay connector shown in FIG. 13 is fixed to a chassis.
Figure 17:
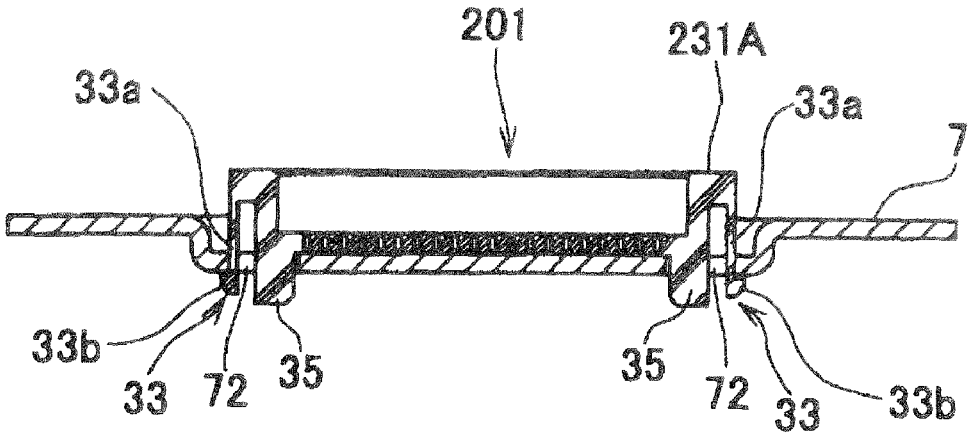
FIG. 17 is a cross-sectional view showing a state after the relay connector shown in FIG. 13 is fixed to the chassis.

FIG. 16 is a perspective view showing a state before the relay connector 201 shown in FIG. 13 is fixed to the chassis 7; and FIG. 17 is a cross-sectional view showing a state after the relay connector 201 shown in FIG. 13 is fixed to the chassis 7.

To fix the relay connector 201 to the chassis 7, as shown in FIG. 16, the relay connector 201 is positioned with respect to the chassis 7 so that the hook 33 and projection 35 of the relay connector 201 are positioned above the hole 72 of the chassis 7, after which the hook 33 and projection 35 of the relay connector 201 are inserted into the hole 72 of the chassis 7.

As a result, the claw 33*b* of the hook 33 of the relay connector 201 is engaged with the peripheral portion of the hole 72 of the chassis 7 as shown in FIG. 17, so that the relay connector 201 is fixed to the chassis 7.

When the relay connector 201 is fixed to the chassis 7, the arm part 33*a* of the hook 33 contacts the inner peripheral surface of the hole 72, but a clearance is formed between the projection 35 and the inner peripheral surface of the hole 72. Therefore, the relay connector 201 can move by the clearance over the chassis 7. Because the first housing body constituting member 231A and the second housing body constituting member 231B are coupled by the expanding portions 253*a* of the contacts 205, they can move separately.

Figure 18:
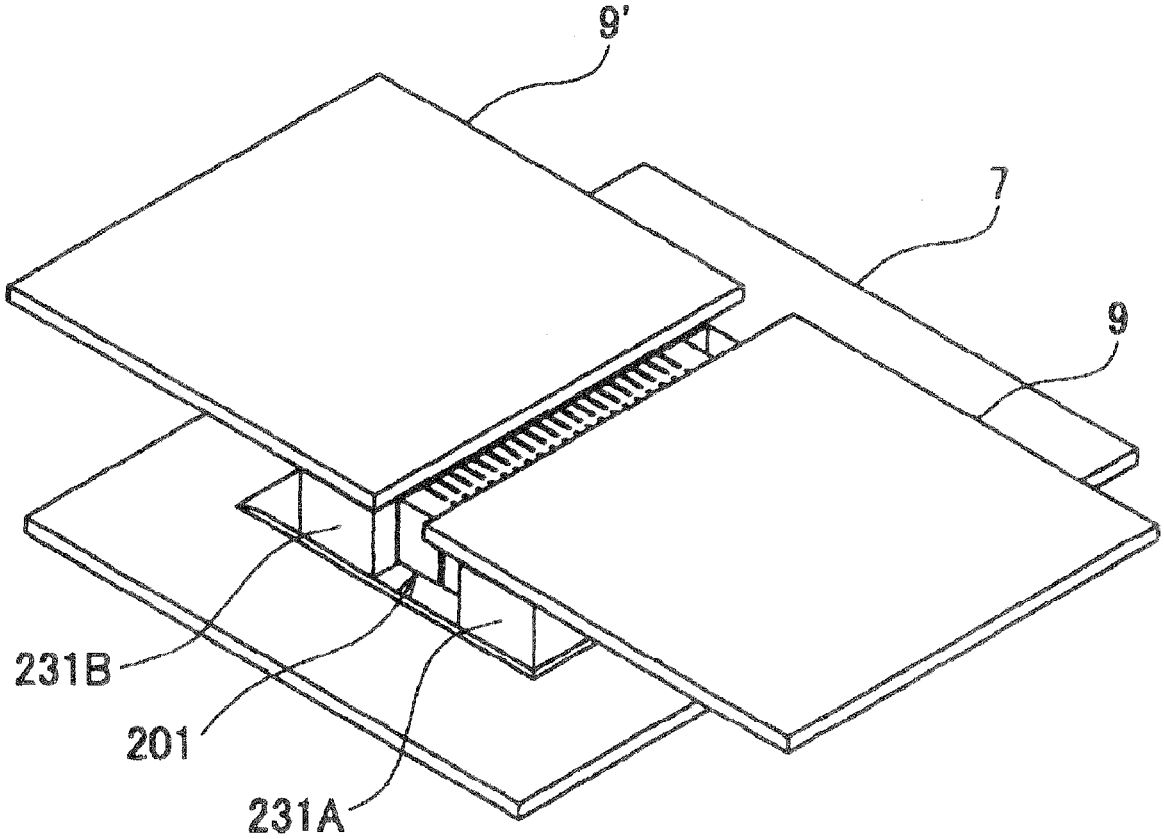
FIG. 18 is a perspective view showing a state after the plug connector is connected to the relay connector shown in FIG. 17.
Figure 19:
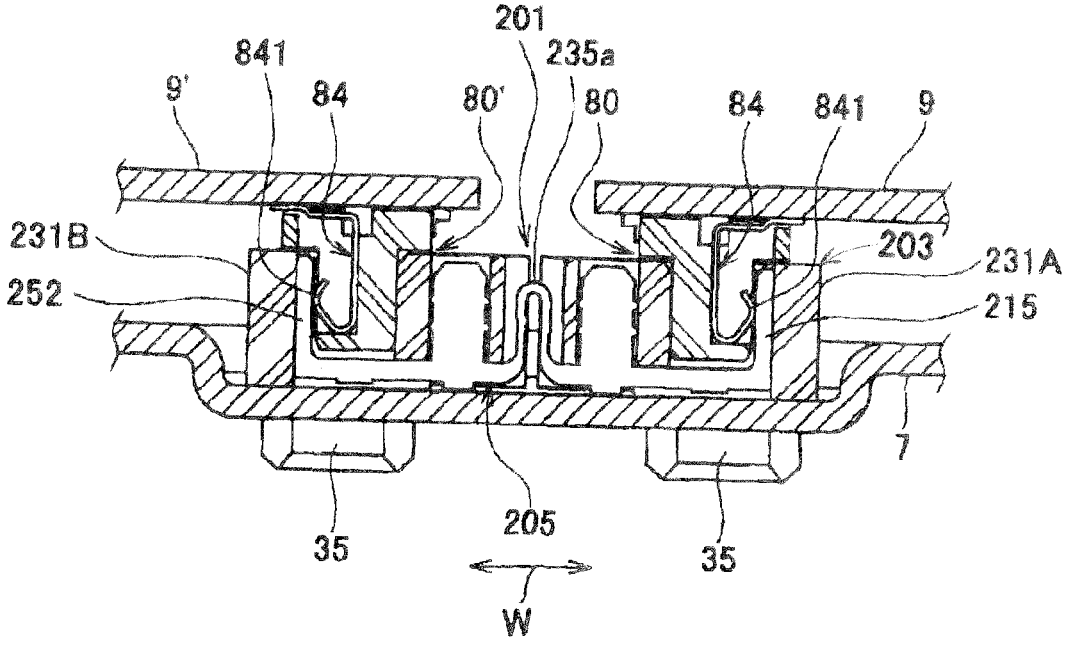
FIG. 19 is a cross-sectional view showing the state after the plug connector is connected to the relay connector shown in FIG. 17.

FIG. 18 is a perspective view showing a state after the plug connectors 80, 80' are connected to the relay connector 201 shown in FIG. 17; and FIG. 19 is a cross-sectional view showing the state after the plug connectors 80, 80' are connected to the relay connector 201 shown in FIG. 17.

To connect the first plug connector 80 mounted on the first printed board 9 and the second plug connector 80' mounted on the second printed board 9' to the relay connector 201, the relay connector 201 should be fixed to the chassis 7 beforehand (see FIG. 17).

Next, the first and second plug connectors 80, 80' are placed over the first and second receiving parts 2311, 2312 of the relay connector 201 respectively (see FIG. 16).

Then, as shown in FIG. 18, the first and second plug connectors 80, 80' are respectively inserted into the first and second receiving parts 2311, 2312 of the relay connector 201.

Since the relay connector 201 is fixed to the chassis 7, connection of the first and second plug connectors 80, 80' to the relay connector 201 can be carried out easily.

Because the first and second housing body constituting members 231A, 231B can move on the chassis 7 a little independently of each other, the deviation of the first plug connector 80 with respect to the first housing body constituting member 231A and the deviation of the second plug connector 80' with respect to second housing body constituting member 231B are absorbed.

When the first and second plug connectors 80, 80' are inserted into the first and second receiving parts 2311, 2312 of the relay connector 201, as shown in FIG. 19, the contacts 205 contact the contacts 84, 84 of the first and second plug connectors 80, 80', allowing the first printed board 9 and the second printed board 9' to be electrically connected together via the re' ay connector 201 and the first and second plug connectors 80, 80'.

According to this embodiment, which achieves similar effects to those of the first embodiment, the first housing body constituting member 231A and the second housing body constituting member 231B are coupled together by the expanding portion 253*a*, so that larger deviations of the first and second plug connectors 80, 80' with respect to the relay connector 201 can be absorbed. Particularly, larger deviations of the first and second plug connectors 80, 80' with respect to the relay connector 201 in the widthwise direction W of the housing 203 can be absorbed.

Next, a relay connector 3101 according to a third embodiment of the present invention will be described referring to the accompanying drawings.

FIGS. 20 to 28 are diagrams showing the relay connector according to the third embodiment of the present invention.

The same reference numerals are allotted to the components in common with those of the first and second embodiments to omit the description therefor. The following will describe only main differences from the first and second embodiments.

While the relay connectors 1, 201 according to the first and second embodiments are each connected to the first and second printed boards 9, 9' via the first and second plug connectors 80, 80', the relay connector 3101 according to this embodiment is directly connected to a first printed board 1110 and a second printed board 1120.

Figure 20:
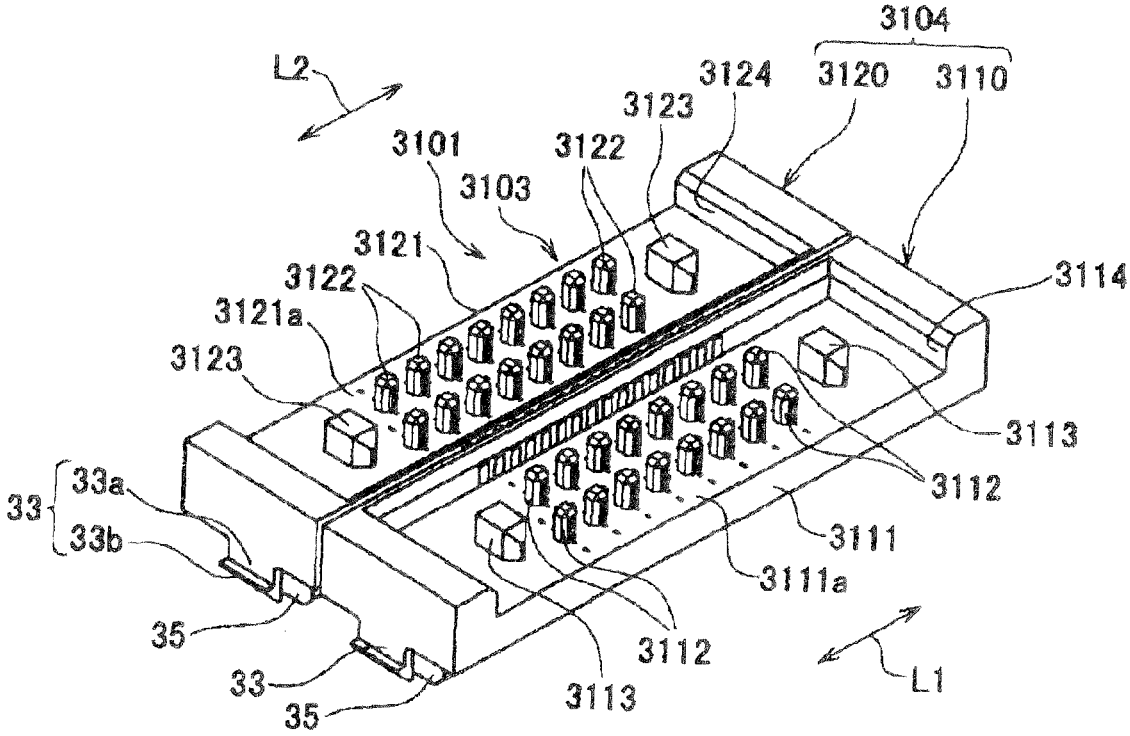
FIG. 20 is a perspective view of a relay connector according to a third embodiment of the present invention.
Figure 21:
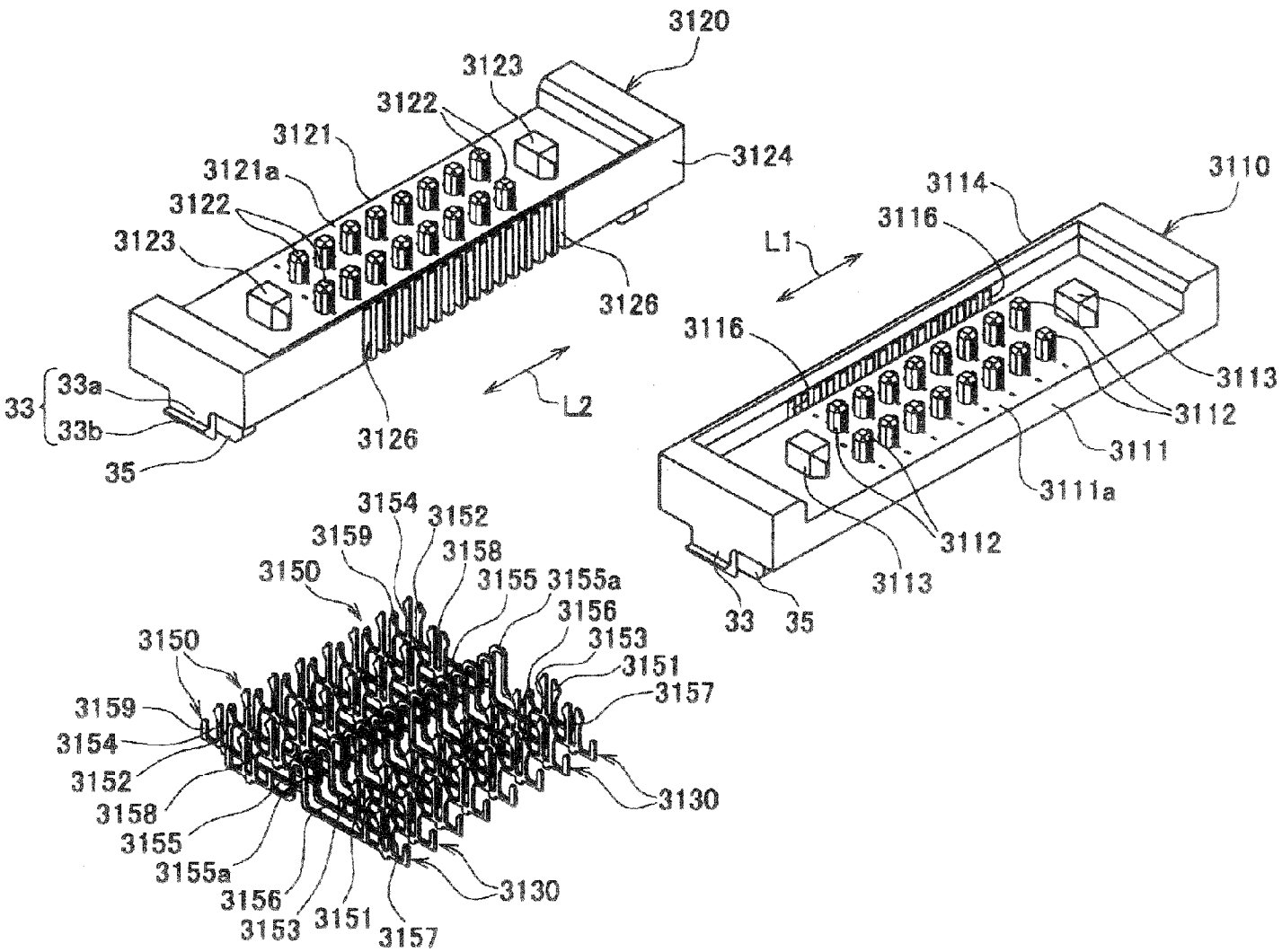
FIG. 21 is an exploded perspective view of the relay connector shown in FIG. 20.
Figure 22:
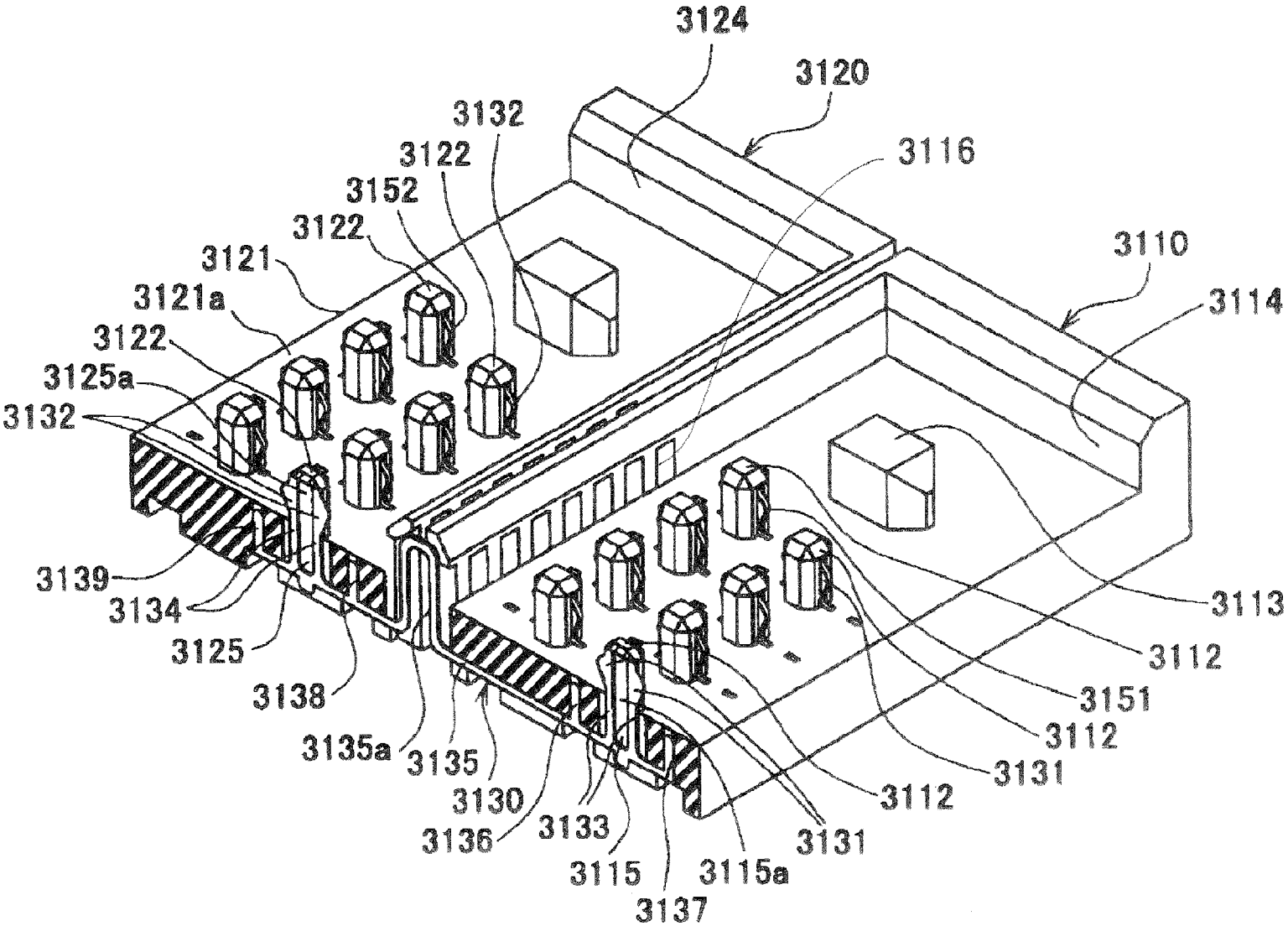
FIG. 22 is a cross-sectional view of the relay connector shown in FIG. 20.

As shown in FIGS. 20 to 22, the connector 3101 is provided with a housing 3103 and contacts 3130, 3150.

The housing 3103 has a housing body 3104, hooks (engagement portions) 33, and projections 35.

The housing body 3104 consists of a first housing body constituting member 3110, and a second housing body constituting member 3120.

The first housing body constituting member 3110 has a base plate 3111 and a plurality of insertion portions 3112 (first link portions), positioning protrusions 3113 and a side wall portion 3114.

Figure 27:
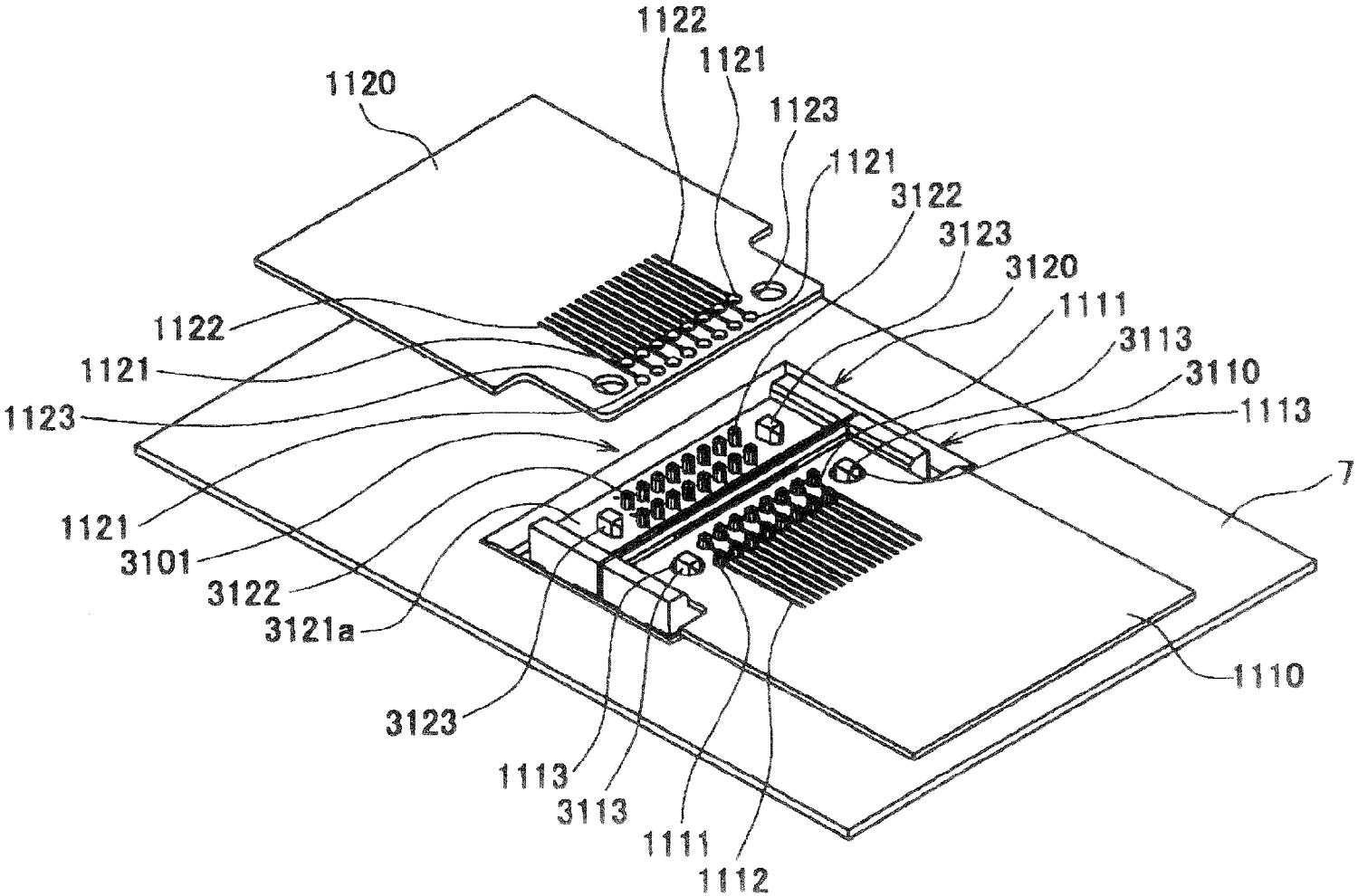
FIG. 27 is a perspective view showing a state where one printed board is connected to the relay connector shown in FIG. 20.

The base plate 3111 has a nearly plate-like shape, and has a support surface 3111*a* which supports an end portion of the first printed board (first connection target) 1110 (see FIG. 27).

The insertion portions 3112, which are nearly columnar, are formed on the support surface 3111*a* of the base plate 3111. The distal end of each insertion portion 3112 is formed into a nearly tapered shape. The insertion portions 3112 are aligned in two rows in a lengthwise direction L1 of the first housing body constituting member 3110 at equal intervals. One row of the insertion portions 3112 is shifted from the other row of the insertion portions 3112 by a half pitch in the lengthwise direction L1.

The positioning protrusions 3113 are formed at both end portions of the support surface 3111*a* of the base plate 3111.

The side wall portion 3114 is formed at the peripheral portion of the support surface 3111*a* of the base plate 3111.

The second housing body constituting member 3120 has approximately the same structure as the first housing body constituting member 3110, and has a base plate 3121 and a plurality of insertion portions 3122 (second link portions), positioning protrusions 3123 and a side wall portion 3124.

The base plate 3121 has a nearly plate-like shape, and has a support surface 3121*a* which supports an end portion of the second printed board (second connection target) 1120 (see FIG. 27).

The insertion portions 3122, which are nearly columnar, are formed on the support surface 3121*a* of the base plate 3121. The distal end of each insertion portion 3122 is formed into a nearly tapered shape. The insertion portions 3122 are aligned in two rows in a lengthwise direction L2 of the second housing body constituting member 3120 at equal intervals. One row of the insertion portions 3122 is shifted from the other row of the insertion portions 3122 by a half pitch in the lengthwise direction L2.

The positioning protrusions 3123 are formed at both end portions of the support surface 3121*a* of the base plate 3121.

The side wall portion 3124 is formed at the peripheral portion of the support surface 3121*a* of the base plate 3121.

The contacts 3130 are formed by punching out a metal plate. The contact 3130 has a first contact portion 3131, a second contact portion 3132, a first spring portion 3133, a second spring portion 3134, a link portion 3135, press-in portions 3136, 3137, and press-in portions 3138, 3139 (see FIG. 22).

The first contact portion 3131 is nearly triangular. The first contact portion 3131 contacts a through hole 1111 (see FIG. 26) of the first printed board 1110.

The second contact portion 3132 is nearly triangular. The second contact portion 3132 contacts a through hole 1121 (see FIG. 26) of the second printed board 1120.

One end of the first spring portion 3133 is coupled to the first contact portion 3131, and the other end of the first spring portion 3133 is coupled to the link portion 3135. The first spring portion 3133 presses the first contact portion 3131 against the through hole 1111.

One end of the second spring portion 3134 is coupled to the second contact portion 3132, and the other end of the second spring portion 3134 is coupled to the link portion 3135. The second spring portion 3134 presses the second contact portion 3132 against the through hole 1121.

The link portion 3135 extends to the second housing body constituting member 3120 from the first housing body constituting member 3110, and has a curved portion (expanding portion) 3135*a* at a position slightly closer to the second spring portion 3134 than the intermediate position thereof. The link portion 3135 is placed over between the first housing body constituting member 3110 and the second housing body constituting member 3120 to couple the first housing body constituting member 3110 and the second housing body constituting member 3120 together.

The press-in portions 3136, 3137 are coupled to one end portion of the link portion 3135 in such a way as to sandwich the first spring portions 3131, 3131. The press-in portions 3136, 3137 are pressed into the first housing body constituting member 3110.

The press-in portions 3138, 3139 are coupled to the other end portion of the link portion 3135 in such a way as to sandwich the second spring portions 3134, 3134. The press-in portions 3138, 3139 are pressed into the second housing body constituting member 3120.

The contacts 3150 are formed by punching out a metal plate. The contact 3150 has the same shape and the same size as the contact 3130 to intend to share parts. It is to be noted that when the contacts 3130, 3150 are pressed into the first and second housing body constituting members 3110 and 3120, it is necessary to set the top surface of the contact 3130 and the bottom surface of the contact 3150 facing in the same direction. The contact 3150 has a first contact portion 3151, a second contact portion 3152, a first spring portion 3153, a second spring portion 3154, a link portion 3155, press-in portions 3156, 3157, and press-in portions 3158, 3159 (see FIG. 21).

As shown in FIG. 21, the first contact portion 3151 is nearly triangular. The first contact portion 3151 contacts the through hole 1111 (see FIG. 26) of the first printed board 1110.

The second contact portion 3152 is nearly triangular. The second contact portion 3152 contacts the through hole 1121 (see FIG. 26) of the second printed board 1120.

One end of the first spring portion 3153 is coupled to the first contact portion 3151, and the other end of the first spring portion 3153 is coupled to the link portion 3155. The first spring portion 3153 presses the first contact portion 3151 against the through hole 1111.

One end of the second spring portion 3154 is coupled to the second contact portion 3152, and the other end of the second spring portion 3152 is coupled to the link portion 3155. The second spring portion 3154 presses the second contact portion 3152 against the through hole 1121.

The link portion 3155 extends to the second housing body constituting member 3120 from the first housing body constituting member 3110, and has a curved portion (expanding portion) 3155*a* at a position slightly closer to the first spring portion 3153 than the intermediate position thereof. The link portion 3155 is placed over between the first housing body constituting member 3110 and the second housing body constituting member 3120 to couple the first housing body constituting member 3110 and the second housing body constituting member 3120 together.

The press-in portions 3156, 3157 are coupled to one end portion of the link portion 3155 in such a way as to sandwich the first contact portions 3151, 3151. The press-in portions 3156, 3157 are pressed into the first housing body constituting member 3110.

The press-in portions 3158, 3159 are coupled to the other end portion of the link portion 3155 in such a way as to sandwich the second spring portions 3154, 3154. The press-in portions 3158, 3159 are pressed into the second housing body constituting member 3120.

The first housing body constituting member 3110 has a plurality of retaining spaces 3115, 3116 as shown in FIG. 22.

The retaining spaces 3115 are formed at the insertion portions 3112 and the base plate 3111. The retaining spaces 3115 are aligned in the lengthwise direction L1 of the first housing body constituting member 3110 at equal intervals. The first spring portions 3133, 3153 are retained in a deformable manner in spaces at the side of the base plate 3111 of the retaining spaces 3115. The first contact portions 3131, 3151 are retained in a deformable manner in spaces at the side of the first insertion portion 3112 (retaining portions 3115*a*) of the retaining spaces 3115. The first contact portions 3131, 3151 partially protrude outside the retaining portions 3115*a*.

The retaining spaces 3116 are formed at the side wall portion 3114 and the base plate 3111. The retaining spaces 3116 are aligned in the lengthwise direction L1 of the first housing body constituting member 3110 at equal intervals.

The second housing body constituting member 3120 has a plurality of retaining spaces 3125, 3126 as shown in FIG. 22.

The retaining spaces 3125 are formed at the insertion portions 3122 and the base plate 3121. The retaining spaces 3125 are aligned in the lengthwise direction L2 of the second housing body constituting member 3120 at equal intervals. The second spring portions 3134, 3154 are retained in a deformable manner in spaces at the side of the base plate 3121 of the retaining spaces 3125. The second contact portions 3132, 3152 are retained in a deformable manner in spaces at the side of the second insertion portion 3122 (retaining portions 3125*a*) of the retaining spaces 3125. The second contact portions 3132, 3152 partially protrude outside the retaining portions 3125*a*.

The retaining spaces 3126 are formed at the side wall portion 3124 and the base plate 3121. The retaining spaces 3126 are aligned in the lengthwise direction L2 of the second housing body constituting member 3120 at equal intervals.

The curved portions 3135*a*, 3155*a* are retained in the retaining spaces 3116, 3126 in a deformable manner. The sizes of the retaining spaces 3116, 3126 in the lengthwise directions L1, L2 are larger than the sizes of the curved portions 3135*a*, 3155*a* in the lengthwise directions L1, L2. As a result, the curved portions 3135*a*, 3155*a* can absorb the deviations between the first housing body constituting member 3110 and the second housing body constituting member 3120 in the lengthwise directions L1, L2.

Figure 26:
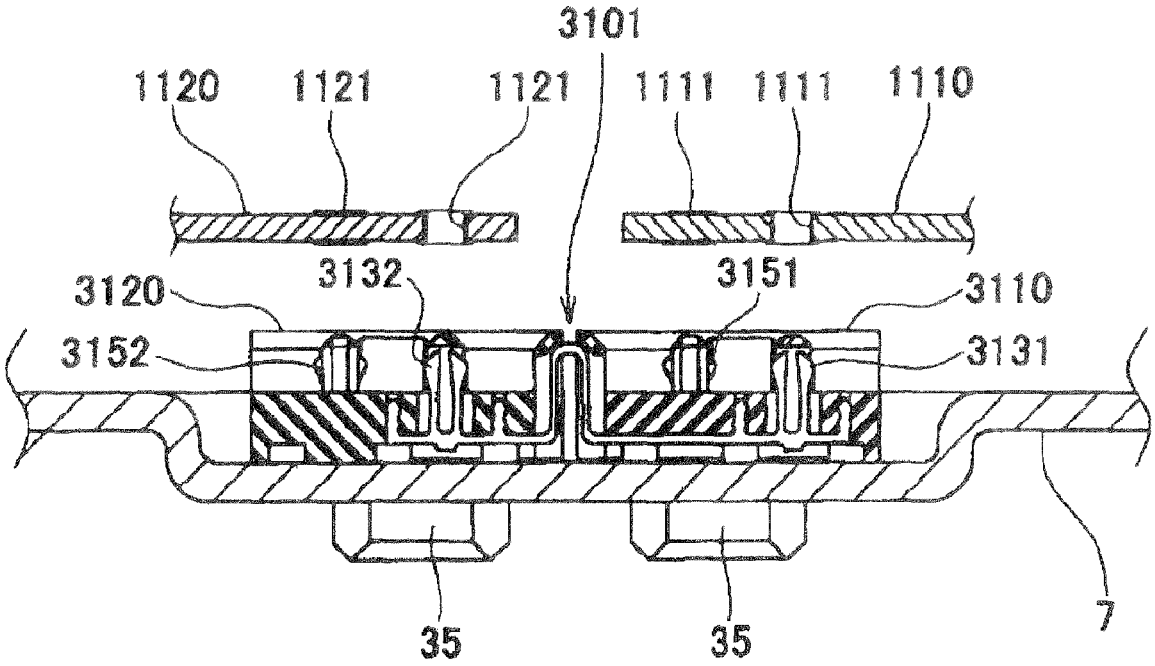
FIG. 26 is a cross-sectional view showing a state before printed boards are fixed to the relay connector shown in FIG. 20.

As shown in FIGS. 26 and 27, conductive passages 1112 are connected to the through holes 1111 of the first printed board 1110. Positioning holes 1113 are formed on the first printed board 1110. The positioning holes 1113 receive the positioning protrusions 3113.

Conductive passages 1122 are connected to the through holes 1121 of the second printed board 1120. Positioning holes 1123 are formed on the second printed board 1120. The positioning holes 1123 receive the positioning protrusions 3123.

To connect the first printed board 1110 and the second printed board 1120 together using connectors 301, the relay connector 3101 should be fixed to the chassis 7 beforehand.

Figure 23:
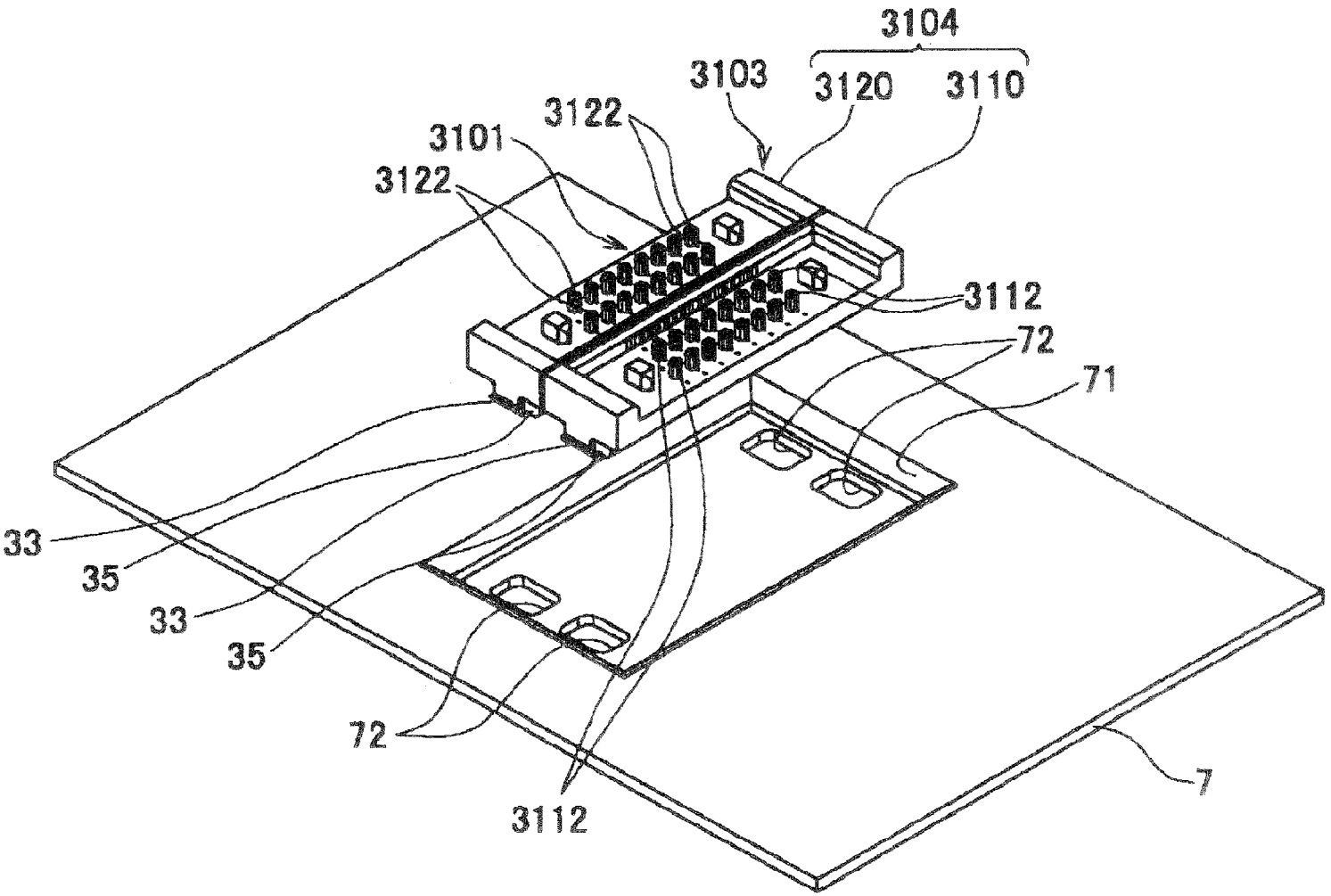
FIG. 23 is a perspective view showing a state before the relay connector shown in FIG. 20 is fixed to a chassis.
Figure 24:
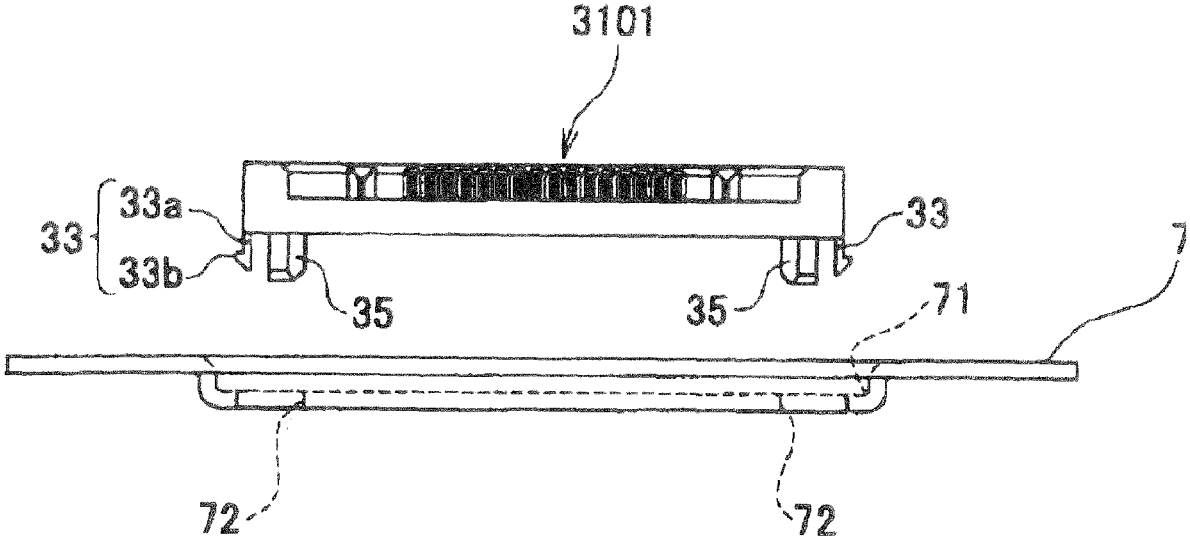
FIG. 24 is a side view showing the state before the relay connector shown in FIG. 20 is fixed to the chassis.

To fix the relay connector 3101 to the chassis, as shown in FIGS. 23 and 24, the relay connector 3101 should be positioned so that the hook 33 and projection 35 are positioned above the hole 72, after which the relay connector 3101 is lowered to permit the hook 33 and projection 35 to be inserted into the hole 72.

Figure 25:
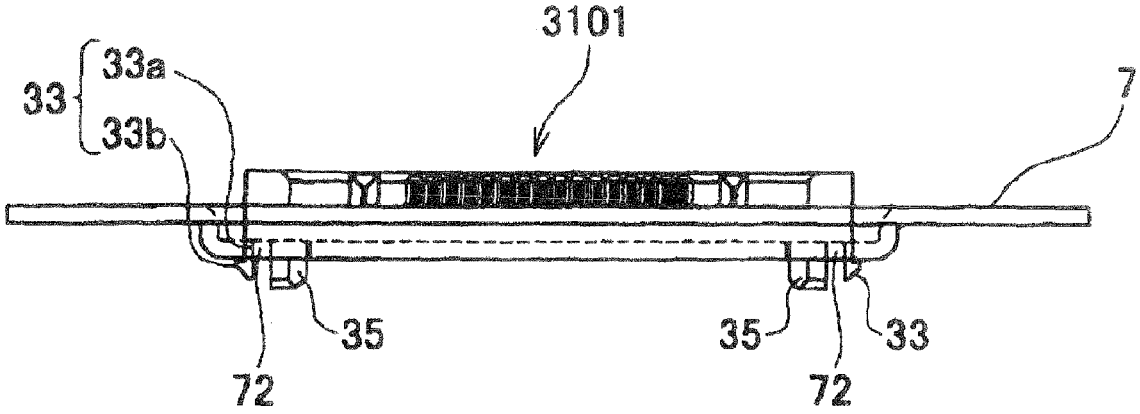
FIG. 25 is a side view showing a state after the relay connector shown in FIG. 20 is fixed to the chassis.

As a result, the claw 33*b* of the hook 33 is hooked at the peripheral portion of the hole 72 as shown in FIG. 25, so that the relay connector 3101 is fixed to the chassis 7.

Next, as shown in FIGS. 26 and 27, the positioning holes 1123 of the second printed board 1120 are aligned with the positioning protrusions 3123 of the second housing body constituting member 3120, and the second printed board 1120 is lowered so that both the positioning protrusions 3123 respectively pass through both positioning holes 1123. Since the second printed board 1120 is positioned to the second housing body constituting member 3120 by the positioning holes 1123 and the positioning protrusions 3123, all the insertion portions 3122 are inserted into all the through holes 1121, allowing the second contact portions 3132, 3152 protruding from the retaining portions 3125*a* to contact the through holes 1121, so that conduction of the contacts 3130, 3150 to the second printed board 1120 is established.

Figure 28:
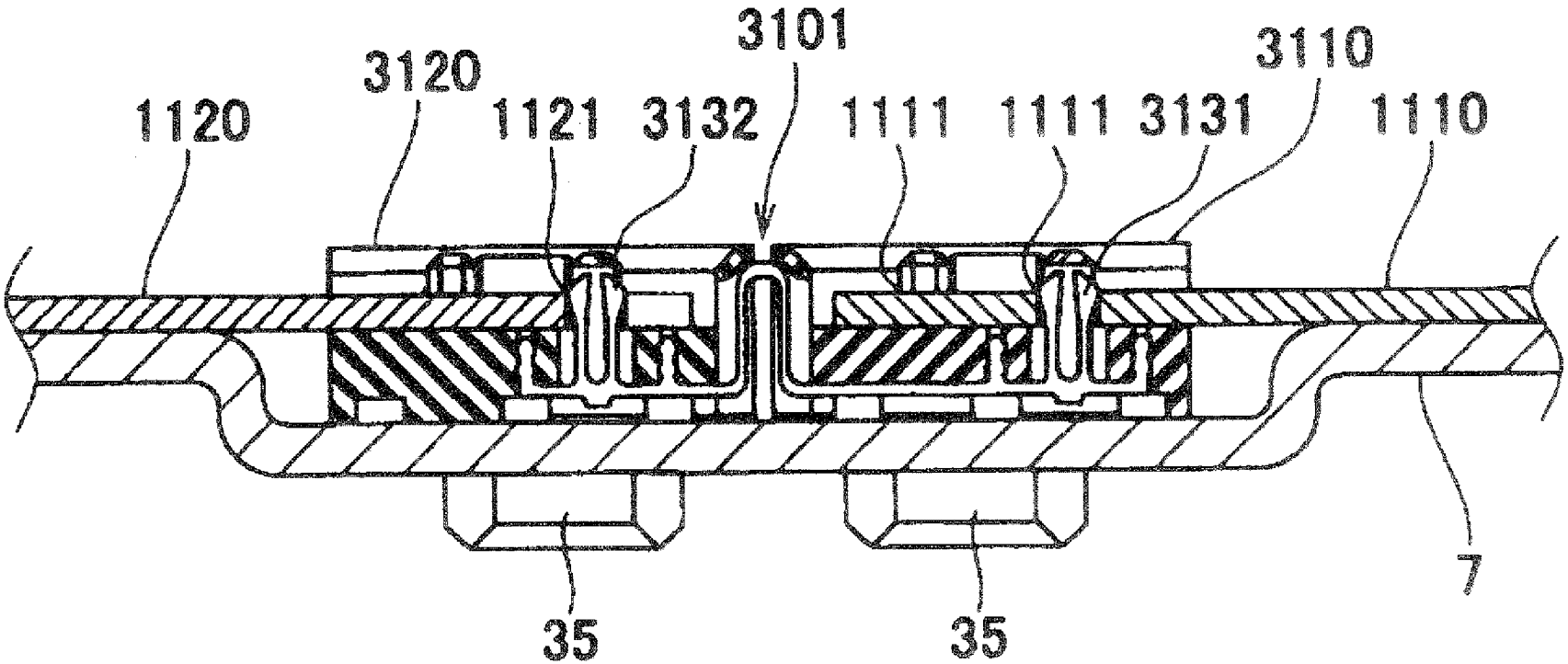
FIG. 28 is a perspective view showing a state where both printed boards are connected to the relay connector shown in FIG. 20.

Likewise, the first printed board 1110 is also mounted on the first housing body constituting member 3110, and the first printed board 1110 and the second printed board 1120 are electrically connected together by the connector 3101, as shown in FIG. 28.

In a case where the second printed board 1120 is placed on the support surface 3121*a* of the second housing body constituting member 3120 to pass the positioning protrusions 3123 through the positioning holes 1123, if the second printed board 1120 is slightly tilted to the support surface 3121*a*, the second contact portions 3132, 3152 are inserted into the through holes 1121 relatively obliquely, thereby producing force which tends to deform the second contact portions 3132, 3152, and the second spring portions 3134, 3154. However, the force is mostly received at the insertion portions 3122, so that the second contact portions 3132, 3152, and the second spring portions 3134, 3154 do not deform. This is applied to a case where the first printed board 1110 is placed on the support surface of the first housing body constituting member 3110 to pass the positioning protrusions 3113 through the positioning holes 1113.

Because the first contact portions 3131, 3151 are protected by the insertion portions 3112, and the second contact portions 3132, 3152 are protected by the insertion portions 3122, a material for the contacts 3130, 3150 for use need not have high strength, and a material with much flexibility can be used. This, as a result, can permit the first and second contact portions 3131, 3151, 3132, 3152 to be easily inserted into the through holes 1111, 1121.

As described above, according to this embodiment, the similar functions and effects to those of the first and second embodiments can be achieved, and the contacts 3130, 3150 can be inserted into the through holes 1111, 1121 easily, making it possible to prevent the deformation of the contacts 3130, 3150.

Because the positioning protrusions 3113, 3123 are provided, even if external force like tensile force is applied to the first and second printed boards 1110, 1120 after the first and second printed boards 1110, 1120 are mounted on the connector 3101, the external force can be received by the positioning protrusions 3113, 3123, making it possible to prevent the insertion portions 3112, 3122 or the like from being broken.

Although the projection 35 which restricts the elastic deformation of the hook 33 is provided in the above-described embodiments, the projection 35 may not be provided.

While the hook 33 is used as an engagement portion and the hole 72 is used as a to-be-engaged portion in the above-described embodiments, the engagement portion is not limited to the hook 33, and the to-be-engaged portion is not limited to the hole 72, either.

While the first and second printed boards 9, 9', 1110, 1120 are mounted on the chassis 7 in above-described embodiments, the mount target of the first and second printed boards 9, 9', 1110, 1120 is not limited to the chassis 7, but there may be a case where the mount target thereof is a casing or the like, for example.

Although the first and second printed hoards 9, 9', 1110, 1120 are connected by the relay connector 1, 201, 3101 in above-described embodiments, the present invention can also be adapted to connections, such as FFC (Flexible Flat Cable) and FPC (Flexible Printed Circuit).

The foregoing description has explained preferable embodiments of the present invention, and it should be apparent to those skilled in the art that the invention may be modified in various forms without departing from the spirit and scope of the invention.

What is claimed is:

1. A connector comprising:

a housing having a first link portion to which a first connection target to be mounted at a mount target is coupled and a second link portion to which a second connection target to be mounted at the mount target is coupled; and a contact held at the housing to establish conduction between the first connection target coupled to the first link portion and the second connection target coupled to the second link portion, wherein the housing comprises a housing body having the first and second link portions, and an engagement portion which is provided at the housing body to engage with a to-be-engaged portion provided at the mount target;

wherein the to-be-engaged portion has a hole therein and the engagement portion comprises an elastic hook to be engaged with the hole; and wherein the housing comprises a projection to be inserted, together with the hook, into the hole, to restrict elastic deformation of the hook.

2. The connector according to claim 1, wherein:

the housing body comprises a first housing body constituting member and a second housing body constituting member separate and independent therefrom, each of the first and second housing body constituting members has the engagement portion, and the contact couples the first and second housing body constituting members, and comprises an expanding portion which absorbs relative deviation between the first and second connection targets.

* * * * *